US009803923B2

(12) United States Patent
Bewlay et al.

(10) Patent No.: US 9,803,923 B2
(45) **Date of Patent: *Oct. 31, 2017**

(54) CRUCIBLE AND EXTRINSIC FACECOAT COMPOSITIONS AND METHODS FOR MELTING TITANIUM AND TITANIUM ALUMINIDE ALLOYS

(71) Applicant: GENERAL ELECTRIC COMPANY, Schenectady, NY (US)

(72) Inventors: Bernard Patrick Bewlay, Niskayuna, NY (US); Stephen Francis Bancheri, Albany, NY (US); Joan McKiever, Ballston Lake, NY (US); Brian Michael Ellis, Mayfield, NY (US)

(73) Assignee: General Electric Company, Niskayuna, NY (US)

( * ) Notice: Subject to any disclaimer, the term of this patent is extended or adjusted under 35 U.S.C. 154(b) by 223 days.

This patent is subject to a terminal disclaimer.

(21) Appl. No.: 14/628,423

(22) Filed: Feb. 23, 2015

(65) Prior Publication Data

US 2015/0168069 A1 Jun. 18, 2015

Related U.S. Application Data

(63) Continuation of application No. 13/693,155, filed on Dec. 4, 2012, now Pat. No. 8,992,824.

(51) Int. Cl.
*F27B 14/10* (2006.01)
*B28B 7/00* (2006.01)
(Continued)

(52) U.S. Cl.
CPC ..... *F27B 14/10* (2013.01); *B28B 1/16* (2013.01); *B28B 7/0002* (2013.01); *B28B 7/28* (2013.01);
(Continued)

(58) Field of Classification Search
CPC . B28B 1/16; B28B 7/0002; B28B 7/28; F27B 14/10; F27B 2014/104; F27D 1/0006; F27M 2001/01
(Continued)

(56) References Cited

U.S. PATENT DOCUMENTS 2,781,261 A 2/1957 Kamlet
2,837,426 A 6/1958 Kamlet
(Continued)

FOREIGN PATENT DOCUMENTS

CA 2057373 12/1991
CN 1060683 4/1992
(Continued)

OTHER PUBLICATIONS

Machine translation of the specification and claims of DE 199 08 952 A1, Sep. 1999.

*Primary Examiner* — Scott Kastler
*Assistant Examiner* — Michael Aboagye
(74) *Attorney, Agent, or Firm* — John P. Darling

(57) ABSTRACT

Crucible compositions and methods of using the crucible compositions to melt titanium and titanium alloys. More specifically, crucible compositions having extrinsic facecoats comprising a rare earth oxide that are effective for melting titanium and titanium alloys for use in casting titanium-containing articles. Further embodiments are titanium-containing articles made from the titanium and titanium alloys melted in the crucible compositions. Another embodiment is a crucible curing device and methods of use thereof.

20 Claims, 8 Drawing Sheets

(51) Int. Cl.
*B28B 7/28* (2006.01)
*B28B 1/16* (2006.01)
*F27D 1/00* (2006.01)

(52) U.S. Cl.
CPC ..... *F27D 1/0006* (2013.01); *F27B 2014/104* (2013.01); *F27M 2001/01* (2013.01)

(58) Field of Classification Search
USPC ..... 266/275, 286, 280; 164/335; 29/447, 29/458; 432/262, 264, 265; 220/648, 220/62.17
See application file for complete search history.

(56) References Cited

U.S. PATENT DOCUMENTS 3,084,060 A 4/1963 Baer et al.
3,180,632 A 4/1965 Katz et al.
3,188,231 A 6/1965 Jastrzebski
3,565,643 A 2/1971 Bergna
3,660,075 A 5/1972 Harbur et al.
3,676,161 A 7/1972 Yates
3,734,480 A * 5/1973 Zanis ..... F27B 14/10 266/275
3,787,143 A 1/1974 Carbonnel et al.
3,961,995 A 6/1976 Alliot et al.
3,969,195 A 7/1976 Dötzer et al.
4,028,096 A 6/1977 Banker et al.
4,040,845 A 8/1977 Richerson et al.
4,148,204 A 4/1979 Dötzer et al.
4,356,152 A 10/1982 Berkman et al.
4,661,316 A 4/1987 Hashimoto et al.
4,703,806 A 11/1987 Lassow et al.
4,710,348 A 12/1987 Brupbacher et al.
4,723,764 A 2/1988 Mizuhara
4,740,246 A 4/1988 Feagin
4,746,374 A 5/1988 Froes et al.
4,755,228 A 7/1988 Sakurai et al.
4,787,439 A 11/1988 Feagin
4,793,971 A 12/1988 Eckert et al.
4,802,436 A 2/1989 Wilson et al.
4,808,372 A 2/1989 Koczak et al.
4,892,693 A 1/1990 Perrotta et al.
4,893,743 A 1/1990 Eylon et al.
4,919,886 A 4/1990 Venkataraman et al.
4,951,929 A 8/1990 Schwarz et al.
4,966,225 A 10/1990 Johnson et al.
4,996,175 A 2/1991 Sturgis
5,011,554 A 4/1991 Fleischer
5,098,484 A 3/1992 Eylon et al.
5,098,653 A 3/1992 Shyh-Chin
5,102,450 A 4/1992 Huang
5,152,853 A 10/1992 Fleischer
5,190,603 A 3/1993 Nazmy et al.
5,205,984 A 4/1993 Rowe
5,263,530 A 11/1993 Colvin
5,284,620 A 2/1994 Larsen, Jr.
5,287,910 A 2/1994 Colvin et al.
5,296,055 A 3/1994 Matsuda
5,297,615 A 3/1994 Aimone et al.
5,299,619 A 4/1994 Chandley et al.
5,305,817 A 4/1994 Borisov et al.
5,346,184 A 9/1994 Ghosh
5,350,466 A 9/1994 Larsen, Jr. et al.
5,354,351 A 10/1994 Kampe et al.
5,366,570 A 11/1994 Mazur et al.
5,368,657 A 11/1994 Anderson et al.
5,372,663 A 12/1994 Shibue et al.
5,407,001 A 4/1995 Yasrebi et al.
5,424,027 A 6/1995 Eylon
5,427,173 A 6/1995 Das et al.
5,429,778 A 7/1995 Patel et al.
5,443,892 A 8/1995 Holcombe et al.
5,453,243 A 9/1995 Hansen et al.
5,464,797 A 11/1995 Yasrebi et al.
5,476,679 A 12/1995 Lewis et al.
5,503,798 A 4/1996 Singheiser et al.
5,580,403 A 12/1996 Mazur et al.
5,602,197 A 2/1997 Johnson et al.
5,603,759 A 2/1997 Burkhart
5,626,179 A 5/1997 Choudhury et al.
5,678,298 A 10/1997 Colvin et al.
5,749,937 A 5/1998 Detering et al.
5,766,329 A 6/1998 LaSalle et al.
5,776,617 A 7/1998 Brady et al.
5,823,243 A 10/1998 Kelly
5,839,504 A 11/1998 Matsuda
5,908,516 A 6/1999 Nguyen-Dinh
5,942,057 A 8/1999 Hanamura et al.
5,944,088 A 8/1999 Feagin
5,950,706 A 9/1999 Choudhury et al.
5,981,083 A 11/1999 Colvin et al.
5,997,802 A 12/1999 Holcombe, Jr. et al.
6,024,163 A 2/2000 Springgate et al.
6,136,094 A 10/2000 Yamaji et al.
6,174,387 B1 1/2001 Bellows et al.
6,174,495 B1 1/2001 Nishikiori
6,250,366 B1 6/2001 Choudhury et al.
6,283,195 B1 9/2001 Chandley et al.
6,284,389 B1 9/2001 Jones et al.
6,352,101 B1 3/2002 Ghosh et al.
6,355,362 B1 3/2002 Jones et al.
6,380,114 B1 4/2002 Brandy
6,408,929 B2 6/2002 Choudhury et al.
6,409,963 B1 6/2002 Gohres et al.
6,425,504 B1 7/2002 Besser et al.
6,443,212 B1 9/2002 Choudhury et al.
6,488,073 B1 12/2002 Blenkinsop et al.
6,524,407 B1 2/2003 Paul et al.
6,596,963 B2 7/2003 Kelly
6,660,109 B2 12/2003 Hajaligol et al.
6,669,791 B2 12/2003 Tetsui et al.
6,705,385 B2 3/2004 Ray et al.
6,723,279 B1 4/2004 Withers et al.
6,746,508 B1 6/2004 Deevi et al.
6,755,239 B2 6/2004 Ray et al.
6,776,214 B2 8/2004 Ray et al.
6,799,626 B2 10/2004 Ray et al.
6,868,814 B2 3/2005 Baur et al.
6,923,934 B2 8/2005 Nishikiori
7,157,148 B2 1/2007 Takai et al.
7,360,579 B2 4/2008 Renkel et al.
7,389,808 B2 6/2008 Renkel et al.
7,389,809 B2 6/2008 Renkel et al.
7,582,133 B2 9/2009 Kelly et al.
7,761,969 B2 7/2010 Bewlay et al.
7,790,101 B2 9/2010 Kelly et al.
8,007,712 B2 8/2011 Bewlay et al.
8,048,365 B2 11/2011 Bewlay et al.
8,062,581 B2 11/2011 Bewlay et al.
8,075,713 B2 12/2011 Renkel
8,136,572 B2 3/2012 Renkel
8,136,573 B2 3/2012 Renkel
8,167,023 B2 5/2012 Renkel
8,579,013 B2 11/2013 Bewlay et al.
8,708,033 B2 * 4/2014 Bewlay ..... C04B 28/06 106/38.3
8,858,697 B2 * 10/2014 Bewlay ..... B22D 21/005 106/38.2
8,992,824 B2 * 3/2015 Bewlay ..... F27D 1/0006 266/276
9,381,566 B2 * 7/2016 Bewlay ..... B22C 9/043
2002/0108679 A1 8/2002 Chandley et al.
2003/0051780 A1 3/2003 Blenkinsop et al.
2004/0045644 A1 3/2004 Guther et al.
2005/0084407 A1 4/2005 Myrick
2007/0107202 A1 5/2007 Das
2007/0199676 A1 8/2007 Wolter
2007/0280328 A1 12/2007 Lee et al.
2008/0003453 A1 1/2008 Ogren
2008/0156147 A1 7/2008 Kelly et al.
2008/0156453 A1 7/2008 Kelly et al.
2008/0260608 A1 10/2008 Rancoule
2008/0290568 A1 11/2008 Bewlay et al.

(56) References Cited

U.S. PATENT DOCUMENTS

| | | | |
|---|---|---|---|
| 2008/0290569 | A1 | 11/2008 | Bewlay et al. |
| 2009/0050284 | A1 | 2/2009 | Seserko |
| 2009/0133850 | A1 | 5/2009 | Kelly et al. |
| 2009/0169415 | A1 | 7/2009 | Chikugo et al. |
| 2009/0321038 | A1 | 12/2009 | Renkel |
| 2010/0089500 | A1 | 4/2010 | Renkel |
| 2011/0091324 | A1 | 4/2011 | Holzschuh |
| 2011/0094705 | A1 | 4/2011 | Kelly et al. |
| 2012/0112391 | A1 | 5/2012 | Bochiechio et al. |
| 2013/0084190 | A1 | 4/2013 | Bewlay et al. |
| 2013/0108459 | A1 | 5/2013 | Bewlay |
| 2013/0210320 | A1 | 8/2013 | Bewlay et al. |
| 2013/0224066 | A1 | 8/2013 | Bewlay et al. |
| 2013/0248061 | A1 | 9/2013 | Kelly et al. |
| 2013/0251537 | A1 | 9/2013 | Weimer et al. |
| 2014/0209268 | A1 | 7/2014 | Bewlay et al. |
| 2015/0224566 | A1* | 8/2015 | Bewlay ..... B22C 9/04 164/529 |

FOREIGN PATENT DOCUMENTS

| | | | |
|---|---|---|---|
| CN | 101829770 | | 9/2010 |
| DE | 19752777 | A1 | 7/1999 |
| DE | 10125129 | A1 | 1/2003 |
| DE | 102009027019 | A1 | 11/2010 |
| EP | 0096985 | A1 | 12/1983 |
| EP | 0238758 | A2 | 9/1987 |
| EP | 0529594 | A1 | 3/1993 |
| EP | 0530968 | A1 | 3/1993 |
| EP | 0560070 | A1 | 9/1993 |
| EP | 0753593 | A1 | 1/1997 |
| EP | 1061149 | A1 | 12/2000 |
| EP | 1797977 | A2 | 6/2007 |
| GB | 569852 | | 6/1945 |
| GB | 783411 | A | 9/1957 |
| GB | 2248071 | A | 3/1992 |
| GB | 2440334 | A | 1/2008 |
| JP | 54157780 | | 12/1979 |
| JP | 01139988 | A | 6/1989 |
| JP | 01184392 | A | 7/1989 |
| JP | 03282187 | A | 12/1991 |
| JP | 0499840 | A | 3/1992 |
| JP | 06009290 | | 1/1994 |
| JP | 06179930 | | 6/1994 |
| JP | 06269927 | A | 9/1994 |
| JP | 0789789 | A | 4/1995 |
| JP | 10204555 | A | 8/1998 |
| JP | 11116399 | A | 4/1999 |
| JP | 2001208481 | A | 8/2001 |
| JP | 2003056988 | A | 2/2003 |
| WO | WO8606366 | A1 | 11/1986 |
| WO | WO8803520 | A1 | 5/1988 |
| WO | WO8910982 | A1 | 11/1989 |
| WO | WO9013377 | A1 | 11/1990 |
| WO | WO9630552 | A1 | 10/1996 |
| WO | 9832557 | | 7/1998 |
| WO | WO9832557 | A1 | 7/1998 |
| WO | WO9927146 | A1 | 6/1999 |
| WO | WO0044959 | A1 | 8/2000 |
| WO | WO0067541 | A1 | 11/2000 |
| WO | WO2008049452 | A1 | 5/2008 |
| WO | WO2011048423 | A1 | 4/2011 |

* cited by examiner

CRUCIBLE AND EXTRINSIC FACECOAT COMPOSITIONS AND METHODS FOR MELTING TITANIUM AND TITANIUM ALUMINIDE ALLOYS

CROSS-REFERENCE TO RELATED APPLICATION

This application is a continuation of U.S. application Ser. No. 13/693,155, filed on Dec. 4, 2012 and entitled Crucible and Extrinsic Facecoat Compositions and Methods for Melting Titanium and Titanium Aluminide Alloys, which is hereby expressively incorporated herein by reference in its entirety.

BACKGROUND

Modern gas or combustion turbines must satisfy the highest demands with respect to reliability, weight, power, economy, and operating service life. In the development of such turbines, the material selection, the search for new suitable materials, as well as the search for new production methods, among other things, play an important role in meeting standards and satisfying the demand.

The materials used for gas turbines may include titanium alloys, nickel alloys (also called super alloys) and high strength steels. For aircraft engines, titanium alloys are generally used for compressor parts, nickel alloys are suitable for the hot parts of the aircraft engine, and the high strength steels are used, for example, for compressor housings and turbine housings. The highly loaded or stressed gas turbine components, such as components for a compressor for example, are typically forged parts. Components for a turbine, on the other hand, are typically embodied as investment cast parts.

Although investment casting is not a new process, the investment casting market continues to grow as the demand for more intricate and complicated parts increase. Because of the great demand for high quality, precision castings, there continuously remains a need to develop new ways to make investment castings more quickly, efficiently, cheaply and of higher quality.

Conventional crucibles are not suitable for casting reactive alloys, such as titanium alloys. One reason is because there is a reaction between molten titanium and the crucible. Any reaction between the molten alloy and the crucible will deteriorate the properties of the final casting. The deterioration can be as simple as poor surface finish due to gas bubbles, or in more serious cases, the chemistry, microstructure, and properties of the casting can be compromised.

The challenge has been to produce a crucible that does not react significantly with titanium and titanium aluminide alloys. In this regard, few if any prior poured ceramic investment compounds exist that meet the requirements for structural titanium and titanium aluminide alloys. Therefore, there is a need for a ceramic crucible that does not react significantly with titanium and titanium aluminide alloys. Approaches have been adopted previously with ceramic shell crucibles for melting titanium alloys. In the prior examples, in order to reduce the limitations of the conventional investment crucible compounds, several additional crucible or mold materials have been developed. For example, a mold investment compound was developed of an oxidation-expansion type in which magnesium oxide or zirconia was used as a main component and metallic zirconium was added to the main constituent to compensate for the shrinkage due to solidification of the cast metal. There is thus also a need for simple and reliable melting and investment casting methods which allow easy melting of metals or metallic alloys in an investment crucible that does not react significantly with the metal or metallic alloy.

Induction melting generally involves heating a metal in a crucible made from a non-conductive refractory alloy oxide until the charge of metal within the crucible is melted to liquid form. When melting highly reactive metals such as titanium or titanium alloys, vacuum induction melting using cold wall or graphite crucibles is typically employed in preference to oxide based ceramic crucibles.

Difficulties can arise when melting highly reactive alloys, such as titanium alloys, as a result of the reactivity of the elements in the alloy at the temperatures needed for melting. While most induction melting systems use refractory alloy oxides for crucibles in the induction furnace, alloys such as titanium aluminide (TiAl) are so highly reactive that they can attack the crucible and contaminate the titanium alloy. For example, ceramic crucibles, such as alumina-, magnesia-, and silica-containing crucibles, are typically avoided because the highly reactive alloys can react with the crucible and contaminate the titanium alloy with oxygen. Similarly, if graphite crucibles are employed, both the titanium and titanium aluminide based alloys can dissolve large quantities of carbon from the crucible into the titanium alloy, thereby resulting in contamination. Such contamination results in the loss of mechanical properties of the titanium alloy.

Cold crucible melting offers metallurgical advantages for the processing of the highly reactive alloys described previously, it also has a number of technical and economic limitations including low superheat, yield losses due to skull formation, high power requirements, and a limited melt capacity. These limitations can restrict its commercial viability.

Accordingly, there remains a need for ceramic crucibles for use in melting highly reactive alloys that are less susceptible to contamination and pose fewer technical and economic limitations than current applications.

SUMMARY

Aspects of the present system provide crucible compositions, methods of melting, methods of casting, and cast articles that overcome the limitations of the conventional techniques are disclosed. Though some aspect of the present description may be directed toward the fabrication of components for the aerospace industry, for example, engine turbine blades, aspects of the present system may be employed in the fabrication of any component in any industry, in particular, those components containing titanium and/or titanium alloys.

In one aspect, the present disclosure provides a crucible for melting titanium and titanium alloys, the crucible comprising: (i) an extrinsic facecoat having at least one extrinsic facecoat layer comprising a rare earth oxide; (ii) a bulk disposed behind the extrinsic facecoat and comprising a calcium aluminate cement; and (iii) a cavity for melting titanium and titanium alloys therein, where the cavity is defined by the exposed surface of the extrinsic facecoat. In one embodiment, the extrinsic facecoat and the bulk have a combined thickness that is substantially uniform in that it does not vary by more than 30 percent throughout the crucible. In another embodiment, the extrinsic facecoat has a thickness of about 50 microns to about 4,000 microns. The term "bulk layer" is used interchangeably herein with the term "backing layer," "bulk," and the like As used herein, the term "extrinsic facecoat" is meant to be distinguishable from an "intrinsic facecoat." In particular, while an "intrinsic facecoat" may comprise the identical species of compositions as its corresponding bulk, an "extrinsic facecoat" as used herein is meant to refer to a facecoat having at least one species of composition that is not contained in the bulk of the crucible.

In certain embodiments, the at least one extrinsic facecoat layer of the extrinsic facecoat comprises about 1% to about 100% by weight of the rare earth oxide. Suitable rare earth oxides for use in the extrinsic facecoat can include, without limitation, yttrium oxide, dysprosium oxide, terbium oxide, erbium oxide, thulium oxide, ytterbium oxide, lutetium oxide, gadolinium oxide, and mixtures thereof. In other embodiments, the rare earth oxide is in the form of a composition that includes, without limitation, a rare earth oxide-alumina garnet, a rare earth oxide-alumina perovskite, a rare earth oxide-alumina mullite, and mixtures thereof.

In one embodiment, the crucible of the present disclosure includes an extrinsic facecoat that comprises at least two extrinsic facecoat layers, with the at least two extrinsic facecoat layers comprising a primary extrinsic facecoat layer and at least one secondary extrinsic facecoat layer disposed between the primary extrinsic facecoat layer and the bulk. In a particular embodiment, the primary extrinsic facecoat layer comprises a rare earth oxide, and the at least one secondary extrinsic facecoat layer comprises either a rare earth oxide or a non-rare earth oxide selected from the group consisting of alumina, calcium oxide, silicon oxide, zirconium oxide, and mixtures thereof.

In one embodiment, the at least one extrinsic facecoat layer is made from a facecoat slurry comprising the rare earth oxide in powder form in a suspension with a colloid suspension. The colloid suspension can comprise a colloid that includes, but is not limited to, colloidal silica, colloidal alumina, colloidal yttria, and mixtures thereof.

In one embodiment, the at least one extrinsic facecoat layer comprises between about 5% to about 95% by weight of fine-scale rare earth oxide particles having a diameter of less than about 50 microns, and between about 20% to about 90% by weight of large-scale rare earth oxide particles having a diameter of more than about 50 microns.

With regard to the bulk of the crucible, in one embodiment, the calcium aluminate cement comprises more than 10% by weight of the bulk. In one embodiment, the calcium aluminate cement of the bulk comprises calcium aluminate particles of less than about 100 microns in diameter. In another embodiment, the calcium aluminate cement of the bulk comprises calcium monoaluminate. In a particular embodiment, the calcium monoaluminate of the bulk comprises a weight fraction of about 0.05 to 0.95.

In another embodiment, the calcium aluminate cement of the bulk further comprises calcium dialuminate, mayenite, or both calcium dialuminate and mayenite. In a particular embodiment, the calcium dialuminate of the bulk comprises a weight fraction of about 0.05 to about 0.80. In another particular embodiment, the mayenite of the bulk comprises a weight fraction of about 0.01 to about 0.30.

In certain embodiments, the bulk of the crucible further comprises alumina. For example, in one embodiment, the alumina of the bulk comprises from about 10% to about 90% by weight of the bulk. The alumina of the bulk can comprise, without limitation, alumina particles of about 10 microns to about 10 millimeters in diameter.

In another embodiment, the bulk comprises from about 10% to about 50% by weight calcium oxide.

In certain embodiments, the crucible of the present disclosure further comprises a bonding layer disposed between the extrinsic facecoat and the bulk, with the bonding layer comprising a fine-scale calcium aluminate cement having a particle size of less than 50 microns. In one embodiment, the fine-scale calcium aluminate cement comprises calcium monoaluminate in a weight fraction of about 0.05 to 0.95 of the bonding layer. In another embodiment, the fine-scale calcium aluminate cement comprises mayenite in a weight fraction of about 0.01 to about 0.30 of the bonding layer. In one example of the crucible, the extrinsic facecoat, the bonding layer, and the bulk have a combined thickness that is substantially uniform in that it does not vary by more than 30 percent throughout the crucible.

In certain embodiments, the crucible of the present disclosure further comprises aluminum oxide particles, magnesium oxide particles, calcium oxide particles, zirconium oxide particles, titanium oxide particles, silicon oxide particles, or mixtures thereof.

An important property of a melting crucible is its ability to withstand thermal gradients during heating of the crucible and the alloy charge in the crucible during the melting cycle; this property can be referred to as the thermal shock resistance. The thermal gradients that occur through the walls of the crucible in the axial and radial directions, and the change in these thermal gradients as a function of time during the melting cycle, generate stresses in the walls of the crucible that can lead to cracking of the crucible. When cracks occur in the crucible walls, the melt can leak out of the crucible, and this can lead to a casting failure.

In one embodiment, the crucible wall thickness is configured so that it does not vary by more than 30 percent, because the wall thickness affects the thermal performance of the crucible. Specifically, the wall thickness and the properties of the crucible wall, such as the elastic modulus, strength, thermal conductivity, and thermal expansion coefficient, control the thermal shock resistance of the crucible. If the crucible wall thickness is not uniform throughout all the walls of the crucible then the crucible walls will not heat up uniformly and this can lead to undesirable thermal stresses in the walls of the crucible and these stresses can lead to cracking of the crucible during melting before casting and leakage of the melt from the crucible.

If the crucible wall thickness is not uniform throughout all the walls of the crucible then the elastic stiffness and the fracture stress of the wall of the crucible will vary, and the mechanical response of the crucible wall to thermal cycle that the crucible experiences during melting will vary and this can lead to undesirable thermal stresses in the walls of the crucible and these stresses can lead to cracking of the crucible during melting before casting and leakage of the melt from the crucible.

As noted, in one embodiment, wall thickness of the crucible does not vary by more than 30 percent throughout the full volume of the crucible. In a particular embodiment, wall thickness of the crucible does not vary by more than 20 percent throughout the full volume of the crucible. In another particular embodiment, wall thickness of the crucible does not vary by more than 15 percent throughout the full volume of the crucible.

The crucible of the present disclosure meets thermal shock resistance requirements for melting titanium or titanium alloys for use in a casting mold that forms a titanium-containing article. For example, in one example, the crucible of the present disclosure meets the thermal shock resistance requirements for melting the titanium or titanium alloys at a temperature of more than 1500° C., and up to 1750° C. for at least 1 second.

The percentage of solids in an initial calcium aluminate—liquid cement mixture used to make the crucible is, in one example, from about 60 to about 80%. In another example, the percentage of solids in the final calcium aluminate—liquid cement mixture with the large scale alumina, used to make the crucible, is from about 65% to about 90%. The percentage of solids is defined as the total solids in the mix divided by the total mass of the liquid and solids in the mix, described as a percentage.

In another aspect, the present disclosure provides a method for preparing a crucible for melting titanium and titanium alloys useful in making a titanium-containing article. This method involves the following steps: (i) providing a removable pattern coated with a crucible extrinsic facecoat, where the extrinsic facecoat comprises at least one extrinsic facecoat layer comprising a rare earth oxide; (ii) forming a crucible bulk behind the extrinsic facecoat, where the bulk comprises a calcium aluminate cement; and (iii) removing the removable pattern to yield a crucible having a cavity for melting titanium and titanium alloys therein, with the cavity being defined by the exposed surface of the extrinsic facecoat, and the extrinsic facecoat and the bulk having a combined thickness that is substantially uniform in that it does not vary by more than 30 percent throughout the crucible.

As used herein, the term "removable crucible cavity pattern" refers to any pattern that is used to form the cavity of a cured crucible. The term "removable crucible cavity pattern" is used interchangeably herein with the term "fugitive pattern," "wax pattern," and the like.

In one embodiment, the method for preparing a crucible for melting titanium and titanium alloys involves using a crucible curing device as disclosed herein. The crucible curing device is effective to form the crucible extrinsic facecoat having a extrinsic facecoat layer or multiple extrinsic facecoat layers of a desired thickness and with the thickness of the extrinsic facecoat layer or layers being uniform or substantially uniform throughout the layer or layers. When using the crucible curing device to prepare the crucible, a crucible mold is positioned in a chamber of the crucible curing device. Prior to, at the time of, or after positioning the crucible mold in the chamber, the at least one extrinsic facecoat layer comprising a rare earth oxide is layered onto a crucible mold. Additional extrinsic facecoat and/or bonding layers may then be added behind the first extrinsic facecoat layer (i.e., the primary extrinsic facecoat layer). Once all of the layers of the extrinsic facecoat and any bonding layers are in place, the bulk of the crucible is then formed behind the extrinsic facecoat.

In one embodiment, the bulk of the crucible is formed behind the extrinsic facecoat by (i) introducing a slurry of calcium aluminate into the crucible mold cavity of the crucible mold positioned in the chamber; and (ii) allowing the slurry to cure in the crucible mold cavity to form a crucible for use in melting titanium and titanium alloys for forming a titanium-containing article, where the allowing step comprises curing the slurry around the removable crucible cavity pattern containing the extrinsic facecoat layered thereon, which is inserted into the crucible mold cavity either prior to said introducing step or after said introducing step. In one embodiment, the slurry is produced by the process as follows: combining calcium aluminate with a liquid to produce a slurry of calcium aluminate, wherein the percentage of solids in the initial calcium aluminate/liquid mixture is about 60% to about 80% and the viscosity of the slurry is about 50 to about 150 centipoise; and adding oxide particles into the slurry such that the solids in the final calcium aluminate/liquid mixture with the large-scale oxide particles is about 65% to about 90%.

In one embodiment, this method further comprises firing the formed crucible. In a particular embodiment, the firing is at a temperature of between about 600° C. and about 1650° C. In another embodiment, this method further comprises incorporating a bonding layer between the extrinsic facecoat and the bulk, with the bonding layer comprising a fine-scale calcium aluminate cement having a particle size of less than 50 microns. In one example, the method produces a crucible such that the extrinsic facecoat, the bonding layer, and the bulk have a combined thickness that is substantially uniform in that it does not vary by more than 30 percent throughout the crucible.

As provided herein, the extrinsic facecoat and the bulk are formulated separately, such that in combination there is minimal differential shrinkage in the extrinsic facecoat and the bulk after firing. Formulating the extrinsic facecoat and the bulk in this manner is effective to prevent and inhibit unwanted separation of a crucible's extrinsic facecoat from the bulk. It is preferred that the extrinsic facecoat remains bonded to the bulk after firing. In one embodiment, "minimal differential shrinkage" refers to a difference in shrinkage of less than about 1 percent (<1.0%) between the extrinsic facecoat and the bulk. In another embodiment, "minimal differential shrinkage" refers to a difference in shrinkage of less than about 0.5 percent (<0.5%) between the extrinsic facecoat and the bulk.

In another aspect, the present disclosure provides a method for melting titanium and titanium alloys. This method involves the following steps: (i) providing a crucible according to the present disclosure; (ii) preheating the crucible; and (iii) melting titanium or a titanium alloy in the heated crucible to produce molten titanium or molten titanium alloy.

In another aspect, the present disclosure provides a casting method for titanium and titanium alloys. This method involves the following steps: (i) performing the method of melting titanium and titanium alloys of the present disclosure in order to yield molten titanium or molten titanium alloy; (ii) pouring the molten titanium or the molten titanium alloy into an investment mold; (iii) solidifying the molten titanium or the molten titanium alloy to form a solidified titanium or titanium alloy casting; and (iv) removing the solidified titanium or titanium alloy casting from the mold. The solidified titanium or titanium alloy casting can then be removed from the mold. In one embodiment, this method can involve firing the mold prior to delivering the molten titanium or titanium alloy from the crucible into the casting mold. In one embodiment, a titanium or titanium alloy article is provided that is made by the melting and casting methods as taught herein.

These and other aspects, features, and advantages of this invention will become apparent from the following detailed description of the various aspects of the present invention taken in conjunction with the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and advantages of the present invention will be readily understood from the following detailed description of aspects of the invention taken in conjunction with the accompanying drawings in which:

FIG. 1A is a cross-sectional view of a crucible that has an extrinsic facecoat with one extrinsic facecoat layer, a bulk, and a cavity. FIG. 1B is a cross-sectional view of a crucible that has an extrinsic facecoat with multiple extrinsic facecoat layers, a bulk, and a cavity. FIG. 1C is a cross-sectional view of a crucible that has an extrinsic facecoat, a bulk, a cavity, and a bonding layer between the extrinsic facecoat and the bulk.

FIG. 2A is a view showing the base of the crucible curing device, the chamber of the base, the effector arm, and the support for the effector arm. FIG. 2B is a close view of a chamber having a crucible mold inserted therein and an effector arm positioned above the chamber and crucible mold. FIG. 2C is a view of the crucible curing device having a crucible mold inserted into the chamber of the base of the device, with the effector arm positioned above the chamber and crucible mold.

DETAILED DESCRIPTION

Figure 1A:
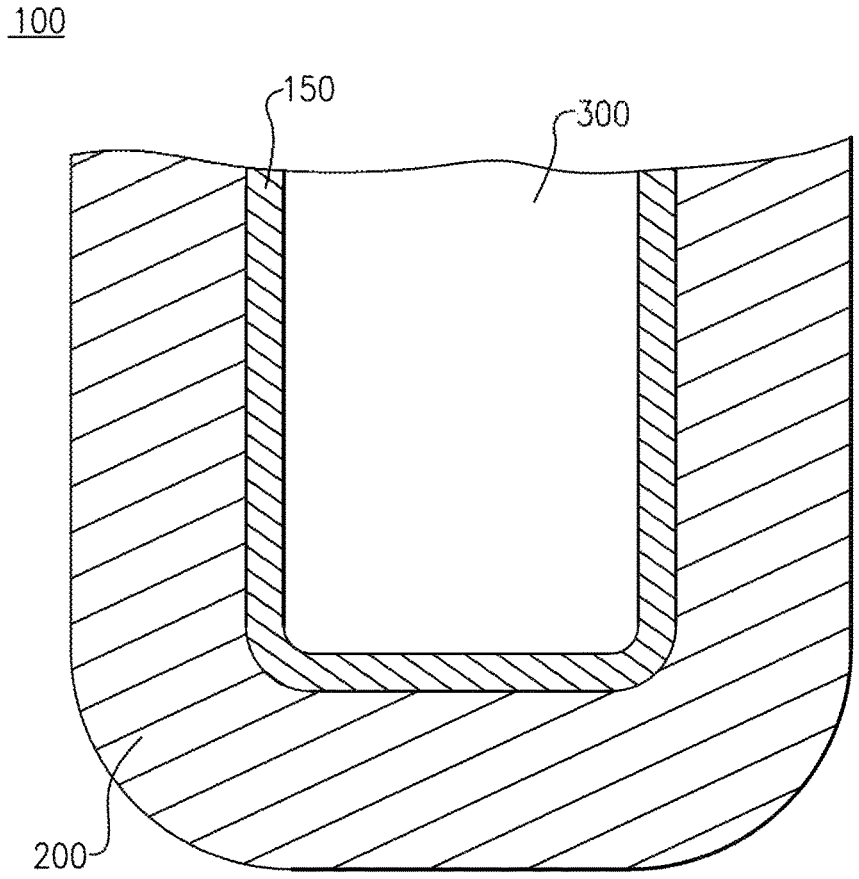
FIGS. 1A-1C are schematic cross-sectional views of one embodiment of a crucible in accordance with the description herein.

The present systems and techniques relate generally to crucible compositions and methods of making crucibles and articles cast from the alloys melted in the crucibles, and, more specifically, to crucible compositions and methods for melting and casting titanium-containing articles, as well as to titanium-containing articles.

The present system provides a new approach for melting titanium and titanium aluminide components, such as, turbine blades or airfoils. Embodiments provide compositions of matter for melting crucibles and melting methods that provide improved titanium and titanium alloy components for example, for use in the aerospace, industrial and marine industry. In some aspects, the crucible composition provides a crucible that contains phases that provide improved crucible strength during crucible making and/or increased resistance to reaction with the metal during melting. The crucibles according to aspects of the present system are capable of preparing molten titanium or titanium alloys for use in casting at high pressure, which is desirable for near-net-shape casting methods. As an example, crucibles with improved properties have been identified where the crucible has an extrinsic facecoat made of a rare earth oxide and a bulk containing a calcium aluminate cement with various constituent phases.

In one aspect, the present disclosure provides a crucible for melting titanium and titanium alloys that includes: (i) an extrinsic facecoat having at least one extrinsic facecoat layer comprising a rare earth oxide; (ii) a bulk disposed behind the extrinsic facecoat and comprising a calcium aluminate cement; and (iii) a cavity for melting titanium and titanium alloys therein, where the cavity is defined by the exposed surface of the extrinsic facecoat. In one embodiment, the extrinsic facecoat and the bulk have a combined thickness that is substantially uniform in that it does not vary by more than 30 percent throughout the crucible. In another embodiment, the extrinsic facecoat has a thickness of about 10 microns to about 4,000 microns.

As provided herein, the crucible of the present disclosure includes an extrinsic facecoat. As used herein, the term "facecoat" refers to the region of the crucible adjacent to the internal surface of the crucible (also referred to as the crucible cavity). As used herein, the term "extrinsic facecoat" refers to a facecoat that contains a component that is not part of the parent crucible formulation. Further, in the present disclosure, the "extrinsic facecoat" includes at least one extrinsic facecoat layer that comprises a rare earth oxide. As used herein, the "extrinsic facecoat" also is meant to include at the least one extrinsic facecoat layer that comprises a rare earth oxide in addition to at least one additional layer, whether that layer be another extrinsic facecoat layer or extrinsic facecoat layers comprising a rare earth oxide, another extrinsic facecoat layer or extrinsic facecoat layers not comprising a rare earth oxide, and/or a bonding layer or bonding layers, as described herein.

In one aspect, the constituent phases of the crucible comprise calcium monoaluminate. Calcium monoaluminate was found desirable for at least two reasons. First, calcium monoaluminate promotes hydraulic bond formation between the cement particles during the initial stages of crucible making, and this hydraulic bonding is believed to provide crucible strength during crucible construction. Second, calcium monoaluminate experiences a very low rate of reaction with titanium and titanium aluminide based alloys. In a certain embodiment, calcium monoaluminate is provided to the crucible composition of the present system, for example, the investment crucibles, in the form of calcium aluminate cement. In one aspect, the crucible composition comprises a mixture of calcium aluminate cement and alumina, that is, aluminum oxide.

In one aspect, the crucible composition provides minimum reaction with the alloy during melting, and the crucible provides castings with the required component properties. External properties of the casting include features such as shape, geometry, and surface finish. Internal properties of the casting include mechanical properties, microstructure, defects (such as pores and inclusions) below a specified size and within allowable limits.

In one embodiment, the crucible composition may be such that the bulk of the crucible comprises alumina and particles larger than about 50 microns.

The percentage of solids in the initial calcium aluminate—liquid cement mix, and the solids in the final calcium aluminate—liquid cement mix are a feature. In one example, the percentage of solids in the initial calcium aluminate—liquid cement mix is from about 60% to about 80%. In one example, the percentage of solids in the initial calcium aluminate—liquid cement mix is from about 60% to about 80%. In another example, the solids in the final calcium aluminate—liquid cement mix with the large scale alumina (>100 microns) alumina particles is from about 75% to about 90%. The initial calcium aluminate cement and the fine-scale (less than 10 micron) alumina are mixed with water to provide a uniform and homogeneous slurry; the final crucible mix is formed by adding large-scale (greater than 100 microns) alumina to the initial slurry and mixing for between 2 and 15 minutes to achieve a uniform mix.

The crucible composition of one aspect provides for low-cost melting and casting of titanium aluminide (TiAl) turbine blades, for example, TiAl low pressure turbine blades. The crucible composition may provide the ability to cast near-net-shape parts that require less machining and/or treatment than parts made using conventional shell crucibles and gravity casting techniques. As used herein, the expression "near-net-shape" implies that the initial production of an article is close to the final (net) shape of the article, reducing the need for further treatment, such as, extensive machining and surface finishing. As used herein, the term "turbine blade" refers to both steam turbine blades and gas turbine blades.

Accordingly, the present system addresses the challenges of producing a crucible, for example, an investment crucible, that does not react significantly with titanium and titanium aluminide alloys. In addition, according to some aspects, the strength and stability of the crucible allow high pressure casting approaches, such as centrifugal casting. One of the technical advantages is that, in one aspect, the present system improves the structural integrity of net shape casting that can be generated, for example, from calcium aluminate cement and alumina investment crucibles. The higher component strength, for example, higher fatigue strength, allows lighter components to be fabricated. In addition, components having higher fatigue strength can last longer, and thus have lower life-cycle costs.

Extrinsic Facecoat

The present disclosure provides a crucible having an extrinsic facecoat comprising a rare earth oxide. Suitable rare earth oxides for use in the extrinsic facecoat can include, without limitation, yttrium oxide, dysprosium oxide, terbium oxide, erbium oxide, thulium oxide, ytterbium oxide, lutetium oxide, gadolinium oxide, and mixtures thereof. In other embodiments, the rare earth oxide is in the form of a composition that includes, without limitation, a rare earth oxide-alumina garnet, a rare earth oxide-alumina perovskite, a rare earth oxide-alumina mullite, and mixtures thereof.

Figure 1B:
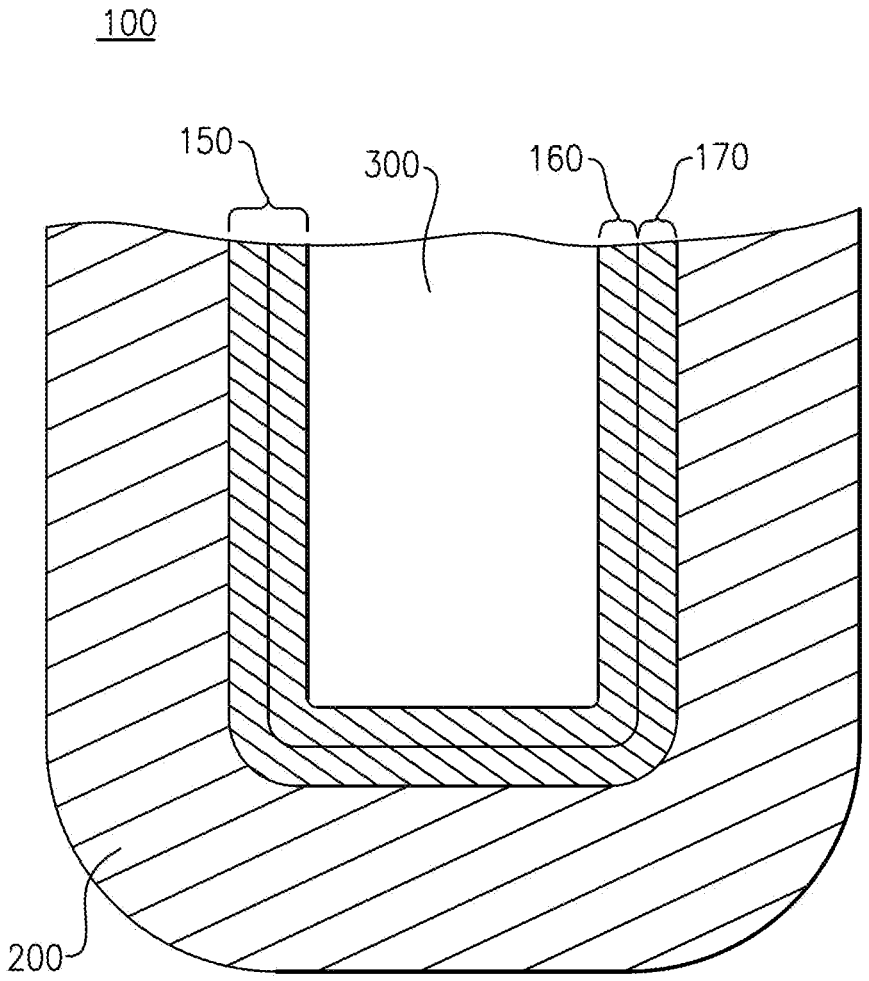
Figure 1C:
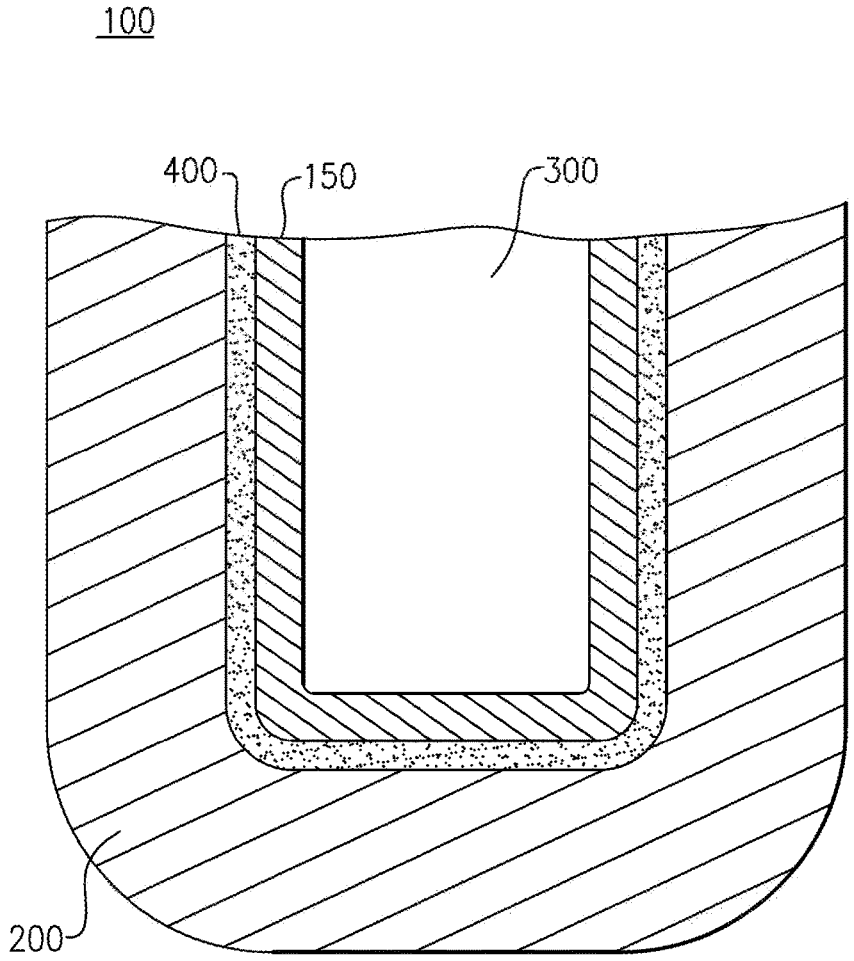

In one embodiment, the extrinsic facecoat comprises at least one extrinsic facecoat layer that comprises between about 1% and about 100% by weight of the rare earth oxide. The present disclosure also provides a crucible having an extrinsic facecoat that comprises multiple extrinsic facecoat layers. In embodiments having multiple extrinsic facecoat layers, the exposed extrinsic facecoat layer is referred to herein as the "primary extrinsic facecoat layer" and the additional extrinsic facecoat layer is referred to as the "secondary extrinsic facecoat layer." In embodiments having more than two extrinsic facecoat layers, the exposed extrinsic facecoat layer is referred to herein as the "primary extrinsic facecoat layer" and the additional extrinsic facecoat layers may be referred to herein collectively a the "secondary extrinsic facecoat layers" or individually as the "first secondary extrinsic facecoat layer," the "second secondary extrinsic facecoat layer," the "third secondary extrinsic facecoat layer," and so on. FIGS. 1A, 1B, and 1C illustrate various embodiments of the crucible having different numbers of extrinsic facecoat layers in the extrinsic facecoat. Further, the present disclosure provides a crucible having an extrinsic facecoat that has other layers in between the extrinsic facecoat layer or layers. The present disclosure also provides a crucible having a bonding layer between the extrinsic facecoat and the bulk of the crucible.

In one example, the crucible of the present disclosure includes an extrinsic facecoat that comprises at least two extrinsic facecoat layers, with the at least two extrinsic facecoat layers comprising a primary extrinsic facecoat layer and at least one secondary extrinsic facecoat layer disposed between the primary extrinsic facecoat layer and the bulk. In a particular embodiment, the primary extrinsic facecoat layer comprises a rare earth oxide, and the at least one secondary extrinsic facecoat layer comprises either a rare earth oxide or a non-rare earth oxide selected from the group consisting of alumina, calcium oxide, silicon oxide, zirconium oxide, and mixtures thereof. In one example, the at least one extrinsic facecoat layer is made from a facecoat slurry comprising the rare earth oxide in powder form in a suspension with a colloid suspension. The colloid suspension can comprise a colloid that includes, but is not limited to, colloidal silica, colloidal alumina, colloidal yttria, and mixtures thereof. In one example, the at least one extrinsic facecoat layer comprises between about 5% to about 95% by weight of fine-scale rare earth oxide particles having a diameter of less than about 50 microns, and between about 20% to about 90% by weight of large-scale rare earth oxide particles having a diameter of more than about 50 microns.

As disclosed herein, the extrinsic facecoat based on a rare earth oxide is effective in protecting a ceramic crucible during the melting of TiAl-based alloys used for investment casting. In particular, the extrinsic facecoat of the present disclosure is effective to protect ceramic melting crucibles from reacting with molten TiAl-based alloys, since typical ceramic melting crucibles, such as alumina-, magnesia-, and silica-based crucibles, react with molten titanium alloys.

In one embodiment, a ceramic crucible system with a rare earth containing extrinsic facecoat (e.g., a primary coating (face-coat)) is fabricated by slurry coating onto removal/wax patterns. In one example, the slurry can be formulated with a colloid such as yttria-containing colloid, or a silica-containing colloid, or an alumina-containing colloid. In one embodiment, the extrinsic facecoat layer is made from a rare earth based powder mix that reacts on heat treatment of the crucible to generate an integral refractory and protective layer on the internal surface of the crucible. In particular embodiments, the extrinsic facecoat is applied as a powder, generally in a slurry form, to a wax model of the internal geometry of the required crucible. One or more layers can be employed. Initially, the layers of the extrinsic facecoat are established, these are layers of the rare earth based crucible material, typically yttria for TiAl-based alloys, although other rare earth elements may be used in place of yttria. Subsequently, the bulk layer containing calcium aluminate cement is applied behind the extrinsic facecoat. The extrinsic facecoat provides a refractory surface for containment of the melt. The bulk layer of the crucible provides support and compliance for management of thermal stress during heating and cooling of the crucible during melting. In one embodiment, alumina bubble in the bulk layer of the crucible improves the thermal shock resistance of the bulk layer of the crucible.

In certain embodiments, a range of extrinsic coat chemistries based on the yttria system can be used to prepare the extrinsic facecoat of the present disclosure. Suitable examples of such compositions can include, without limitation, pure yttria, yttria-alumina garnet (YAG), yttria-alumina perovskite (YAP), $Y_4Al_4O_9$-(YAM—yttria-alumina mullite), and mixtures of these compounds. These species can all reduce the reaction of the crucible with the melt. Yttrium can be replaced in the above compounds either partially, or completely, with other rare earths, such as dysprosium, terbium, erbium, thulium, ytterbium, lutetium, etc. The interface between the extrinsic facecoat and the bulk layer can be graded with layers of different properties to allow the use of more conventional materials in the secondary layers of the extrinsic facecoat, such as alumina and silica based powders.

In a particular embodiment, the yttria extrinsic facecoat has a higher thermal expansion coefficient than the calcium aluminate cement and alumina bulk layer of the crucible. When the titanium alloy charge is heated in the crucible by induction, the yttria extrinsic facecoat heats up first and expands against the bulk layer of the crucible. The yttria extrinsic facecoat is therefore placed in compression during heating, first because it heats up faster than the bulk layer, and second because it has a higher thermal coefficient of expansion. The state of compression of the yttria is preferred to tension, because compression helps to prevent crack nucleation and propagation in the extrinsic facecoat, and it helps to prevent spallation of the extrinsic facecoat from the crucible into the melt during melting. The alumina bubble in the bulk layer of the crucible improves the thermal shock resistance of the bulk layer of the crucible.

As disclosed herein, the extrinsic facecoat of the crucible provides minimum reaction with the alloy during melting, and as a result the crucible provides castings with the required component properties. External properties of the casting include features such as shape, geometry, and surface finish. Internal properties of the casting include alloy chemistry, mechanical properties, microstructure, and defects (such as pores and inclusions) below a critical size.

The treatment of the extrinsic facecoat and the crucible from room temperature to the final firing temperature prior to use in alloy melting can also be important, specifically the thermal history and the humidity profile. The heating rate to the firing temperature, and the cooling rate after firing are very important. If the extrinsic facecoat and the crucible are heated too quickly, they can crack internally or externally, or both; extrinsic facecoat and crucible cracking prior to casting is highly undesirable, it will generate defects in the subsequent casting. In addition, if the crucible and extrinsic facecoat are heated too quickly the extrinsic facecoat of the crucible can crack and spall off; this can lead to undesirable inclusions in the final casting in the worst case, and poor surface finish, even if there are no inclusions. If the extrinsic facecoat and the crucible are cooled too quickly after reaching the maximum crucible firing temperature, the extrinsic facecoat or the bulk of the crucible can also crack internally or externally, or both.

Bonding Layer

While not required, in certain embodiments, the crucible of the present disclosure can further comprise a bonding layer disposed between the extrinsic facecoat and the bulk. In a particular embodiment, the bonding layer comprises a fine-scale calcium aluminate cement having a particle size of less than 50 microns. In one embodiment, the fine-scale calcium aluminate cement comprises calcium monoaluminate in a weight fraction of about 0.05 to 0.95 of the bonding layer. In another embodiment, the fine-scale calcium aluminate cement comprises mayenite in a weight fraction of about 0.01 to about 0.30 of the bonding layer. In one example of the crucible, the extrinsic facecoat, the bonding layer, and the bulk have a combined thickness that is substantially uniform in that it does not vary by more than 30 percent throughout the crucible.

The bonding layer is effective to improve adhesion between the extrinsic facecoat and bulk of the crucible. Further, the use of a bonding layer with typical extrinsic facecoats of the crucible extrinsic facecoat can provide further enhancements of the crucible. In a typical extrinsic facecoat that is used without a bonding layer between the extrinsic facecoat and the bulk layer of the crucible, the extrinsic facecoat can degenerate, crack, and spall during crucible processing, melting, and casting. The pieces of facecoat that become detached from the extrinsic facecoat can become entrained in the casting, and the pieces of ceramic facecoat become inclusions in the final part. While the rare earth oxide extrinsic facecoat of the present disclosure is an improvement over typical extrinsic facecoats, such as zircon, the above noted inclusions can reduce the mechanical performance of the component that is produced from the casting. Thus, while a bonding layer is not required in accordance with the crucible of the present disclosure, it can provide some improved performance.

The calcium aluminate-containing bonding layer can be applied to the rare earth containing extrinsic facecoat as a slurry of the calcium aluminate in, for example, water. A calcium aluminate cement can also be used as a source of the calcium aluminate for the bonding layer. The bonding layer can be applied using conventional processes such as dipping, coating, or spraying. The bonding layer can be applied, for example, by dipping the extrinsic rare earth containing facecoat on the removable pattern into the slurry that contains the calcium aluminate. The backing layer can then be applied after the bonding layer has been applied to the rare earth containing extrinsic facecoat. Alternatively, the dipping process can be replaced by spraying, or other coating processes.

Bulk Layer of the Crucible: Calcium Aluminate Cement Composition

As set forth herein, the calcium aluminate cement comprises calcium monoaluminate. In one embodiment, the calcium aluminate cement can include calcium monoaluminate and calcium dialuminate. In another embodiment, the calcium aluminate cement can include calcium monoaluminate and mayenite.

In a particular embodiment, the calcium aluminate cement used in certain aspects can typically comprise three phases or components of calcium and aluminum: calcium monoaluminate, calcium dialuminate, and mayenite. Calcium monoaluminate is a hydraulic mineral present in calcium alumina cement. Calcium monoaluminate's hydration contributes to the high early strength of the investment crucible. Mayenite is desirable in the cement because it provides strength during the early stages of crucible curing due to the fast formation of hydraulic bonds. The mayenite is, however, typically removed during firing/heat treatment of the crucible prior to melting.

In one aspect, the initial calcium aluminate cement formulation is typically not at thermodynamic equilibrium after firing in the cement manufacturing kiln. However, after crucible making and high-temperature firing, the crucible composition moves towards a thermodynamically stable configuration, and this stability is advantageous for the subsequent melting process. In one embodiment, the weight fraction of calcium monoaluminate in the cement is greater than 0.5, and weight fraction of mayenite is less than 0.15. The mayenite is incorporated in the crucible in the bulk of the crucible because it is a fast curing calcium aluminate and it is believed to provide the bulk of the crucible with strength during the early stages of curing. Curing may be performed at low temperatures, for example, temperatures between 15 degrees Celsius and 40 degrees Celsius because the fugitive wax pattern is temperature sensitive and loses its shape and properties on thermal exposure above about 35 degrees C. It is preferred to cure the crucible at temperatures below 30 degrees C.

The calcium aluminate cement may typically be produced by mixing high purity alumina with high purity calcium oxide; the mixture of compounds is typically heated to a high temperature, for example, temperatures between 1000 and 1500 degrees C. in a furnace or kiln and allowed to react.

Further, the calcium aluminate cement is designed and processed to have a minimum quantity of impurities, such as, minimum amounts of silica, sodium and other alkali, and iron oxide; these minimum values of impurities ensure minimum contamination of the melt by the crucible. In one aspect, the target level for the calcium aluminate cement is that the sum of the $Na_2O$, $SiO_2$, $Fe_2O_3$, and $TiO_2$ is less than about 2 weight percent. In one embodiment, the sum of the $Na_2O$, $SiO_2$, $Fe_2O_3$, and $TiO_2$ is less than about 0.5 weight percent In one embodiment, the silica concentration in the formulation for the bulk layer is less than 2 weight percent. In another embodiment, the silica concentration in the formulation for the bulk layer is less than 1 weight percent.

In one aspect, a calcium aluminate cement with bulk alumina concentrations over 35% weight in alumina ($Al_2O_3$) and less than 65% weight calcium oxide is provided. In a related embodiment, this weight of calcium oxide is less than 50%. In one example, the maximum alumina concentration of the cement may be about 85% (for example, about 15% CaO). In one embodiment, the calcium aluminate cement is of high purity and contains up to 70% alumina. The weight fraction of calcium monoaluminate may be maximized in the fired crucible prior to melting. A minimum amount of calcium oxide may be required to minimize reaction between the alloy that is being melted and the crucible. If there is more than 50% calcium oxide in the cement, this can lead to phases such as mayenite and tricalcium aluminate, and these do not perform as well as the calcium monoaluminate during melting. The preferred range for calcium oxide is less than about 50% and greater than about 10% by weight.

As noted above, the three phases in the calcium aluminate cement/binder in the crucible are calcium monoaluminate, calcium dialuminate, and mayenite. The calcium monoaluminate in the cement has three advantages over other calcium aluminate phases. First, the calcium monoaluminate is incorporated in the crucible because it has a fast curing response (although not as fast as mayenite) and it is believed to provide the crucible with strength during the early stages of curing. The rapid generation of crucible strength provides dimensional stability of the melting crucible. Second, the calcium monoaluminate is chemically stable with regard to the titanium and titanium aluminide alloys that are being melted. The calcium monoaluminate is preferred relative to the calcium dialuminate, and other calcium aluminate phases with higher alumina activity; these phases are more reactive with titanium and titanium aluminide alloys that are being cast. Third, the calcium monoaluminate and calcium dialuminate are low expansion phases and are understood to reduce the formation of high levels of stress in the crucible during curing, dewaxing, and subsequent melting.

Composition of the Bulk Layer of the Crucible

Aspects of the present disclosure provide a composition of matter for crucibles that can provide improved components of titanium and titanium alloys. In one aspect, calcium monoaluminate can be provided in the form of calcium aluminate cement. Calcium aluminate cement may be referred to as a "cement" or "binder" in the bulk layer of the crucible. In certain embodiments, calcium aluminate cement is mixed with alumina particulates to provide a castable investment crucible mix. The calcium aluminate cement may be greater than about 30% by weight in the castable crucible mix. In certain embodiments, the calcium aluminate cement is between about 30% and about 60% by weight in the castable crucible mix. The use of greater than 30% by weight of calcium aluminate cement in the castable crucible mix for the bulk layer (melting crucible composition) is a further feature. The selection of the appropriate calcium aluminate cement chemistry and alumina formulation are factors in the performance of the crucible. In one aspect, a sufficient amount of calcium oxide may be provided in the crucible composition in order to minimize reaction with the titanium alloy.

In one aspect, the crucible composition, for example, the bulk layer crucible composition, may comprise a multi-phase mixture of calcium aluminate cement and alumina particles. The calcium aluminate cement may function as a binder, for example, the calcium aluminate cement binder may provide the main skeletal structure of the crucible structure. The calcium aluminate cement may comprise a continuous phase in the crucible and provide strength during curing, firing, and melting. The crucible bulk layer composition may consist of calcium aluminate cement and alumina, that is, calcium aluminate cement and alumina may comprise substantially the only components of the crucible composition, with little or no other components. In one embodiment, the present system comprises a titanium-containing article melting-crucible bulk layer composition comprising calcium aluminate. In another embodiment, the melting-crucible bulk layer composition further comprises oxide particles, for example, hollow oxide particles. According to other aspects, the oxide particles may be aluminum oxide particles, magnesium oxide particles, calcium oxide particles, zirconium oxide particles, titanium oxide particles, silicon oxide particles, combinations thereof, or compositions thereof. In one embodiment, the oxide particles may be a combination of one or more different oxide particles.

The melting-crucible bulk layer composition can further include aluminum oxide, for example, in the form of hollow particles, that is, particles having a hollow core or a substantially hollow core substantially surrounded by an oxide. These hollow aluminum oxide particles may comprise about 99% of aluminum oxide and have about 10 millimeter (mm) or less in outside dimension, such as, width or diameter. In one embodiment, the hollow aluminum oxide particles have about 1 millimeter (mm) or less in outside dimension, such as, width or diameter. In another embodiment, the aluminum oxide comprises particles that may have outside dimensions that range from about 10 microns [μm] to about 10 millimeter [mm]. In certain embodiments, the hollow oxide particles may comprise hollow alumina spheres (typically greater than 100 microns in diameter). The hollow alumina spheres may be incorporated into the melting-crucible bulk layer composition, and the hollow spheres may have a range of geometries, such as, round particles, or irregular aggregates. In certain embodiments, the alumina may include both round particles and hollow spheres. In one aspect, these geometries were found to increase the fluidity of the investment crucible mixture. The aluminum oxide comprises particles ranging in outside dimension from about 10 microns to about 10,000 microns. In certain embodiments, the aluminum oxide comprises particles that are less than about 500 microns in outside dimension, for example, diameter or width. The aluminum oxide may comprise from about 0.5% by weight to about 80% by weight of the melting-crucible bulk layer composition. Alternatively, the aluminum oxide comprises from about 40% by weight to about 60% by weight of the melting-crucible bulk layer composition. Alternatively, the aluminum oxide comprises from about 40% by weight to about 68% by weight of the melting-crucible bulk layer composition.

In one embodiment, the melting-crucible composition further comprises calcium oxide. The calcium oxide may be greater than about 10% by weight and less than about 50% by weight of the melting-crucible composition. The final crucible typically may have a density of less than 2 grams/cubic centimeter and strength of greater than 500 pounds per square inch [psi]. In one embodiment, the calcium oxide is greater than about 30% by weight and less than about 50% by weight of the melting-crucible composition. Alternatively, the calcium oxide is greater than about 25% by weight and less than about 35% by weight of the melting-crucible composition.

One aspect is a crucible with a rare-earth containing extrinsic facecoat and a bulk layer for melting a titanium-containing article, the bulk layer comprising: a calcium aluminate cement comprising calcium monoaluminate, calcium dialuminate, and mayenite, wherein the extrinsic facecoat of the crucible is about 10 microns to about 4,000 microns between the bulk of the crucible and the crucible cavity.

In a specific embodiment, the melting-crucible composition of the bulk comprises a calcium aluminate cement. The calcium aluminate cement includes at least three phases or components comprising calcium and aluminum: calcium monoaluminate, calcium dialuminate, and mayenite. In one embodiment, the calcium monoaluminate in the bulk of the crucible comprises a weight fraction of about 0.05 to 0.95. In another embodiment, the calcium dialuminate in the bulk of the crucible comprises a weight fraction of about 0.05 to about 0.80. In yet another embodiment, the mayenite in the bulk of the crucible composition comprises a weight fraction of about 0.01 to about 0.30.

The weight fraction of calcium monoaluminate in the calcium aluminate cement may be more than about 0.4, and the weight fraction of mayenite in the calcium aluminate cement may be less than about 0.15. In another embodiment, the calcium aluminate cement is more than 30% by weight of the melting-crucible composition. In one embodiment, the calcium aluminate cement has a particle size of about 50 microns or less.

In one embodiment, the weight fractions of these phases that are suitable in the cement of the bulk of the crucible are 0.05 to 0.95 of calcium monoaluminate, 0.05 to 0.80 of calcium dialuminate, and 0.01 to 0.30 of mayenite. In one embodiment, the weight fraction of calcium monoaluminate in the cement of the bulk of the crucible is more than about 0.5, and weight fraction of mayenite is less than about 0.15.

In one embodiment, the calcium aluminate cement has a particle size of about 50 microns or less. A particle size of less than 50 microns is preferred for three reasons: first, the fine particle size is believed to promote the formation of hydraulic bonds during crucible mixing and curing; second, the fine particle size is understood to promote inter-particle sintering during firing, and this can increase the crucible strength; and third, the fine particle size is believed to improve the surface finish of the crucible and this helps delivery of the melt from the crucible. The calcium aluminate cement may be provided as powder, and can be used either in its intrinsic powder form, or in an agglomerated form, such as, as spray dried agglomerates. The calcium aluminate cement can also be pre-blended with fine-scale (for, example, less than 10 micron in size) alumina. The fine-scale alumina is believed to provide an increase in strength due to sintering during high-temperature firing. In certain instances, larger-scale alumina (that is, greater than 10 microns in size) may also be added with or without the fine-scale alumina. In a particular embodiment, approximately 80% of the calcium aluminate cement has a particle size of less than about 10 microns.

In one embodiment, the bulk layer formulation can also contain hollow alumina particles. The hollow alumina particles serve at least two functions: (1) they reduce the density and the weight of the crucible, with minimal reduction in strength; strength levels of approximately 500 psi and above are obtained, with densities of approximately 2 g/cc and less; and (2) they reduce the elastic modulus of the crucible and help to provide compliance during heating of the crucible during the melting cycle.

The Crucible and Melting and Casting Methods

As described herein, one aspect of the present disclosure is a crucible for melting titanium and titanium alloys. The crucible includes an extrinsic facecoat having at least one layer comprising a rare earth oxide, a bulk, and a cavity for melting the titanium and titanium alloys therein. In a particular embodiment, the bulk comprises a calcium aluminate cement as provided herein, and more particularly includes a calcium aluminate cement that comprises calcium monoaluminate. In another embodiment, the crucible includes an extrinsic facecoat that includes multiple extrinsic facecoat layers. In yet another embodiment, the crucible includes a bonding layer in between the extrinsic facecoat and the bulk layer that contains calcium aluminate.

FIGS. 1A and 1B are schematic diagrams of the above embodiments of the crucible. In one embodiment, as shown in FIG. 1A, crucible 100 includes extrinsic facecoat 150, bulk 200, and cavity 300, with extrinsic facecoat 150 comprising a single extrinsic facecoat layer. In another embodiment, as shown in FIG. 1B, crucible 100 includes extrinsic facecoat 150, bulk 200, and cavity 300, with extrinsic facecoat 150 comprising multiple extrinsic facecoat layers. In particular, as shown in FIG. 1B, the multiple extrinsic facecoat layers include primary extrinsic facecoat layer 160 and secondary extrinsic facecoat layer 170. In one embodiment, as shown in FIG. 1C, crucible 100 includes extrinsic facecoat 150, bulk 200, cavity 300, and bonding layer 400 disposed between extrinsic facecoat 150 and bulk 200. While FIGS. 1A, 1B, and 1C show bulk portions (e.g., walls) and extrinsic facecoats having a particular width relative to one another, the present disclosure is not meant to be limited to the relative widths as shown in FIGS. 1A, 1B, and 1C. The ratio of the wall thickness to the crucible diameter can include, without limitation, ratios as small as 1:4 and as high as 1:75. For example, the ratio of the wall thickness to the crucible diameter can include, without limitation, ratios of approximately 1:10. The ratio of the extrinsic facecoat thickness to the wall thickness can include, without limitation, ratios as small as 1:6, and as high as 1:75. For example, the ratio of the extrinsic facecoat thickness to the wall thickness can include, without limitation, ratios of approximately 1:50. In other embodiments, the range of ratios of the extrinsic facecoat thickness to the wall thickness can be from 1:4 to 1:27.

In all of the embodiments of FIGS. 1A, 1B, and 1C, cavity 300 can be formed using a removable crucible cavity pattern. Further aspects, characteristics, and methods of using the "removable crucible cavity patterns" are described elsewhere in the present disclosure.

In another aspect, the present disclosure provides a method for preparing a crucible for melting titanium and titanium alloys useful in making a titanium-containing article. This method involves the following steps: (i) providing a removable pattern coated with a crucible extrinsic facecoat, where the extrinsic facecoat comprises at least one extrinsic facecoat layer comprising a rare earth oxide; (ii) forming a crucible bulk or bulk layer behind the extrinsic facecoat, where the bulk comprises a calcium aluminate cement; and (iii) removing the removable pattern to yield a crucible having a cavity for melting titanium and titanium alloys therein, with the cavity being defined by the exposed surface of the extrinsic facecoat, and the extrinsic facecoat and the bulk having a combined thickness that is substantially uniform in that it does not vary by more than 30 percent throughout the crucible.

As used herein, the term "removable crucible cavity pattern" refers to any pattern that is used to form the cavity of a cured crucible. The term "removable crucible cavity pattern" is used interchangeably herein with the term "fugitive pattern," "wax pattern," and the like.

In one embodiment, the method for preparing a crucible for melting titanium and titanium alloys involves using a crucible curing device as disclosed herein. The crucible curing device is effective to form the crucible having an extrinsic facecoat layer or multiple extrinsic facecoat layers of a desired thickness and with the thickness of the extrinsic facecoat layer or layers being uniform or substantially uninform throughout the layer or layers. When using the crucible curing device to prepare the crucible, a crucible mold is positioned in a chamber of the crucible curing device. Prior to positioning the crucible mold in the chamber, the at least one extrinsic facecoat layer comprising a rare earth oxide is layered onto a crucible mold. Once all of the layers of the extrinsic facecoat and the removable pattern are in place, the bulk of the crucible is then formed behind the extrinsic facecoat.

In one embodiment, the bulk of the crucible is formed behind the extrinsic facecoat by (i) introducing a slurry of calcium aluminate into the crucible mold cavity of the crucible mold positioned in the chamber; and (ii) allowing the slurry to cure in the crucible mold cavity to form a crucible for use in melting titanium and titanium alloys for forming a titanium-containing article, where the allowing step comprises curing the slurry around the removable crucible cavity pattern containing the extrinsic facecoat layered thereon, which is inserted into the crucible mold cavity either prior to said introducing step or after said introducing step. In one embodiment, the calcium aluminate containing slurry for the bulk layer is produced by the process as follows: combining calcium aluminate with a liquid to produce a slurry of calcium aluminate, wherein the percentage of solids in the initial calcium aluminate/liquid mixture is about 60% to about 80% and the viscosity of the slurry is about 50 to about 150 centipoise; and adding oxide particles into the slurry such that the solids in the final calcium aluminate/liquid mixture with the large-scale oxide particles is about 65% to about 90%.

In one embodiment, this method further comprises firing the formed crucible. In a particular embodiment, the firing is at a temperature of between about 600° C. and about 1650° C. In another embodiment, this method further comprises incorporating a bonding layer between the extrinsic facecoat and the bulk, with the bonding layer comprising a fine-scale calcium aluminate cement having a particle size of less than 50 microns. In one example, the method produces a crucible such that the extrinsic facecoat, the bonding layer, and the bulk have a combined thickness that is substantially uniform in that it does not vary by more than 30 percent throughout the crucible.

An extrinsic facecoat can be formed on a removable crucible cavity pattern prior to adding the bulk and bulk/bonding layer. Once the extrinsic facecoat is in place in the crucible mold in the crucible curing device, an invested crucible is formed by formulating the investment mix of the ceramic components, and pouring the mix into a mold in a vessel that contains a fugitive pattern. The investment crucible formed on the pattern is allowed to cure thoroughly to form a so-called "green crucible." The investment crucible formed on the pattern is allowed to cure thoroughly to form this green crucible. Typically, curing of the green crucible is performed for times from 1 hour to 48 hours. Subsequently, the fugitive pattern is selectively removed from the green crucible by melting, dissolution, ignition, or other known pattern removal technique. Typical methods for wax pattern removal include oven dewax (less than 150 degrees C.), furnace dewax (greater than 150 degrees C.), steam autoclave dewax, and microwave dewaxing.

For melting titanium alloys, and titanium aluminide and its alloys, the green crucible then is fired at a temperature above 600 degrees C., for example 600 to 1750 degrees C., for a time period in excess of 1 hour, preferably 2 to 10 hours, to develop crucible strength for casting and to remove any undesirable residual impurities in the crucible, such as metallic species (Fe, Ni, Cr), and carbon-containing species. In one example, the firing temperature is at least 950 degrees C. The atmosphere of firing the crucible is typically ambient air, although inert gas or a reducing gas atmosphere can be used.

The firing process also removes the water from the crucible and converts the mayenite to calcium monoaluminate and calcium dialuminate. Another purpose of the crucible firing procedure is to minimize any free silica that remains in the bulk of crucible prior to melting. In one embodiment, the free silica in the extrinsic facecoat and the free silica in the bulk layer are less than 2 weight percent after firing. Other purposes are to increase the high temperature strength, and increase the amount of calcium monoaluminate and calcium dialuminate.

The crucible is heated from room temperature to the final firing temperature, such that the thermal history is controlled. The heating rate to the firing temperature, and the cooling rate after firing are typically regulated or controlled. If the crucible is heated too quickly, it can crack internally or externally, or both; crucible cracking prior to melting is highly undesirable. In addition, if the crucible is heated too quickly, the internal surface of the crucible can crack and spall off. This can lead to undesirable inclusions in the final casting, and poor surface finish, even if there are no inclusions. Similarly, if the crucible is cooled too quickly after reaching the maximum temperature, the crucible can also crack internally or externally, or both.

The crucible composition described herein is particularly suitable for titanium and titanium aluminide alloys. The extrinsic facecoat and the bulk of the crucible composition after firing and before melting can influence the crucible properties, particularly with regard to the constituent phases. In one embodiment, for melting purposes, a high weight fraction of calcium monoaluminate in the crucible is preferred, for example, a weight fraction of 0.15 to 0.8. In addition, for melting purposes, it is desirable to minimize the weight fraction of the mayenite, for example, using a weight fraction of 0.01 to 0.2, because mayenite is water sensitive and it can provide problems with water release and gas generation during melting. After firing, the crucible can also contain small weight fractions of amorphous phases, aluminosilicates and calcium aluminosilicates. The sum of the weight fraction of amorphous phases, aluminosilicates and calcium aluminosilicates may typically be kept to less than 5% in the bulk of the crucible, in order to minimize reaction of the crucible during melting.

In one embodiment, the bulk layer is formed behind the extrinsic facecoat by combining calcium aluminate with a liquid to produce a slurry of calcium aluminate, wherein the percentage of solids in the initial calcium aluminate/liquid mixture is about 60% to about 80% and the viscosity of the slurry is about 50 to about 150 centipoise; adding oxide particles into the slurry such that the solids in the final calcium aluminate/liquid mixture with the large-scale (greater than 50 microns) oxide particles is about 75% to about 90%; introducing the slurry into a crucible mold cavity that contains a fugitive pattern; and allowing the slurry to cure in the crucible mold cavity to form a crucible of a titanium-containing article.

In certain embodiments, the melting-crucible composition comprises an investment melting-crucible composition. The melting-crucible composition comprises a near-net-shape, titanium-containing metal, melting crucible composition. In one embodiment, the melting-crucible composition comprises a melting-crucible composition for casting near-net-shape titanium aluminide articles. The near-net-shape titanium aluminide articles comprise, for example, near-net-shape titanium aluminide turbine blades.

The selection of the correct calcium aluminate cement chemistry and alumina formulation are factors in the performance of the crucible during melting. In terms of the calcium aluminate cement, it may be necessary to minimize the amount of free calcium oxide in order to minimize reaction with the titanium alloy. If the calcium oxide concentration in the cement is less than about 10% by weight, the alloy reacts with the crucible because the alumina concentration is too high, and the reaction generates undesirable oxygen concentration levels in the casting, gas bubbles, and a poor surface finish in the cast component. Free alumina is less desirable in the crucible material because it can react aggressively with titanium and titanium aluminide alloys during melting. In one embodiment there is less than 2 weight percent free alumina in the primary layer of the extrinsic facecoat of the crucible after firing.

If the calcium oxide concentration in the cement is greater than 50% by weight, the crucible can be sensitive to pick up of water and carbon dioxide from the environment. As such, the calcium oxide concentration in the investment crucible may typically be kept below 50%. In one embodiment, the calcium oxide concentration in the bulk of the investment crucible is between 10% and 50% by weight. In one embodiment, the calcium oxide concentration in the bulk of the investment crucible is between 10% and 40% by weight. Alternatively, the calcium oxide concentration in the bulk of the investment crucible may be between 25% and 35% by weight.

If the adsorbed water level is too high, for example, greater than 0.05 weight percent, when the molten metal is generated in the crucible during melting, the water is released and it can react with the alloy. This leads to poor surface finish, gas bubbles in the casting, high oxygen concentration, and poor mechanical properties.

According to one aspect, the molten metal or alloy is poured into the casting mold using conventional techniques which can include gravity, countergravity, pressure, centrifugal, and other casting techniques known to those skilled in the art. Vacuum or an inert gas atmospheres can be used. For complex shaped thin wall geometries, techniques that use high pressure are preferred. After the solidified titanium aluminide or alloy casting is cooled typically to less than 650 degrees, for example, to room temperature, it is removed from the mold and finished using conventional techniques, such as, grit blasting, and polishing.

One aspect is a melting and casting method for titanium and titanium alloys comprising: obtaining an invested melting crucible composition with an extrinsic facecoat and a bulk layer comprising calcium aluminate and aluminum oxide, wherein the calcium aluminate is combined with a liquid to produce a slurry of calcium aluminate, and wherein the solids in the final calcium aluminate/liquid mixture with the large scale alumina is about 75% to about 90%, and wherein the resulting crucible has a rare earth oxide containing extrinsic facecoat; pouring the investment crucible composition into a vessel containing a fugitive pattern that includes an extrinsic facecoat layered thereon; curing the investment melting crucible composition; removing the fugitive pattern from the crucible; firing the crucible; preheating the mold to a mold casting temperature; pouring molten titanium or titanium alloy into the heated mold; solidifying the molten titanium or titanium alloy and forming a solidified titanium or titanium alloy casting; and removing the solidified titanium or titanium alloy casting from the mold. In one embodiment, a titanium or titanium alloy article is claimed that is made by the casting method as taught herein.

One aspect is directed to a melting and casting method for titanium and titanium alloys comprising: obtaining an investment casting-crucible with an extrinsic facecoat and a bulk layer composition comprising calcium aluminate and aluminum oxide; pouring the investment casting-crucible composition into a vessel containing a fugitive pattern having a rare earth oxide containing extrinsic facecoat layered thereon; curing the investment casting-crucible composition; removing the fugitive pattern from the crucible to yield a crucible according to the present disclosure; firing the crucible; preheating the mold to a mold casting temperature; pouring molten titanium or titanium alloy from the crucible into the heated mold; solidifying the molten titanium or titanium alloy; and removing a solidified titanium or titanium alloy from the mold.

In one embodiment, the curing step is conducted at temperatures below about 30 degrees C. for between one hour to 48 hours. The removing of the fugitive pattern includes the step of melting, dissolution, ignition, oven dewaxing, furnace dewaxing, steam autoclave dewaxing, or microwave dewaxing.

In one embodiment, the method includes: combining calcium aluminate with a liquid, such as water, to produce a slurry of calcium aluminate in the liquid; introducing the slurry into a vessel that contains a fugitive pattern having a rare earth oxide containing extrinsic facecoat layered thereon; and allowing the slurry to cure in the crucible mold cavity to form a crucible of a titanium-containing article. In one embodiment, the method further comprises, before introducing the slurry into a crucible mold cavity, introducing oxide particles, for example hollow oxide particles, to the slurry.

In one embodiment, the firing step is conducted at temperatures from about 800 degrees C. to about 1750 degrees C. for between one hour to 48 hours. A temperature range of about 1000 degrees C. to about 1750 degrees C. is more preferred, and hold times at the final firing temperature of one hour to 8 hours are more preferred.

If the crucible wall thickness is not uniform throughout all the walls of the crucible then the crucible walls will not heat up uniformly and this can lead to undesirable thermal stresses in the walls of the crucible and these stresses can lead to cracking of the crucible during melting before casting, and leakage of the melt from the crucible.

If the crucible wall thickness is not uniform throughout all the walls of the crucible then the elastic stiffness and the fracture stress of the wall of the crucible will vary, and the mechanical response of the crucible wall to thermal cycle that the crucible experiences during melting will vary and this can lead to undesirable thermal stresses in the walls of the crucible and these stresses can lead to cracking of the crucible during melting before casting, and leakage of the melt from the crucible.

In one embodiment, the wall thickness of the crucible does not vary by more than 30 percent throughout the full volume of the crucible. In another embodiment, the wall thickness of the crucible does not vary by more than 20 percent throughout the full volume of the crucible. In another embodiment, the wall thickness of the crucible does not vary by more than 15 percent throughout the full volume of the crucible.

A further aspect is a method for producing a crucible for melting titanium or titanium alloys for use in forming a titanium-containing article, said method comprising: providing a crucible curing device of the present invention; positioning a crucible mold in the chamber of the crucible curing device, said crucible mold comprising a crucible mold cavity; introducing a slurry comprising calcium aluminate cement into the crucible mold cavity of the crucible mold positioned in the chamber; and allowing the slurry to cure in the crucible mold cavity to form a crucible for use in melting titanium and titanium alloys for forming a titanium-containing article, wherein said allowing step comprises curing the slurry around the removable crucible cavity pattern inserted into the crucible mold cavity either prior to said introducing step or after said introducing step.

Figure 2A:
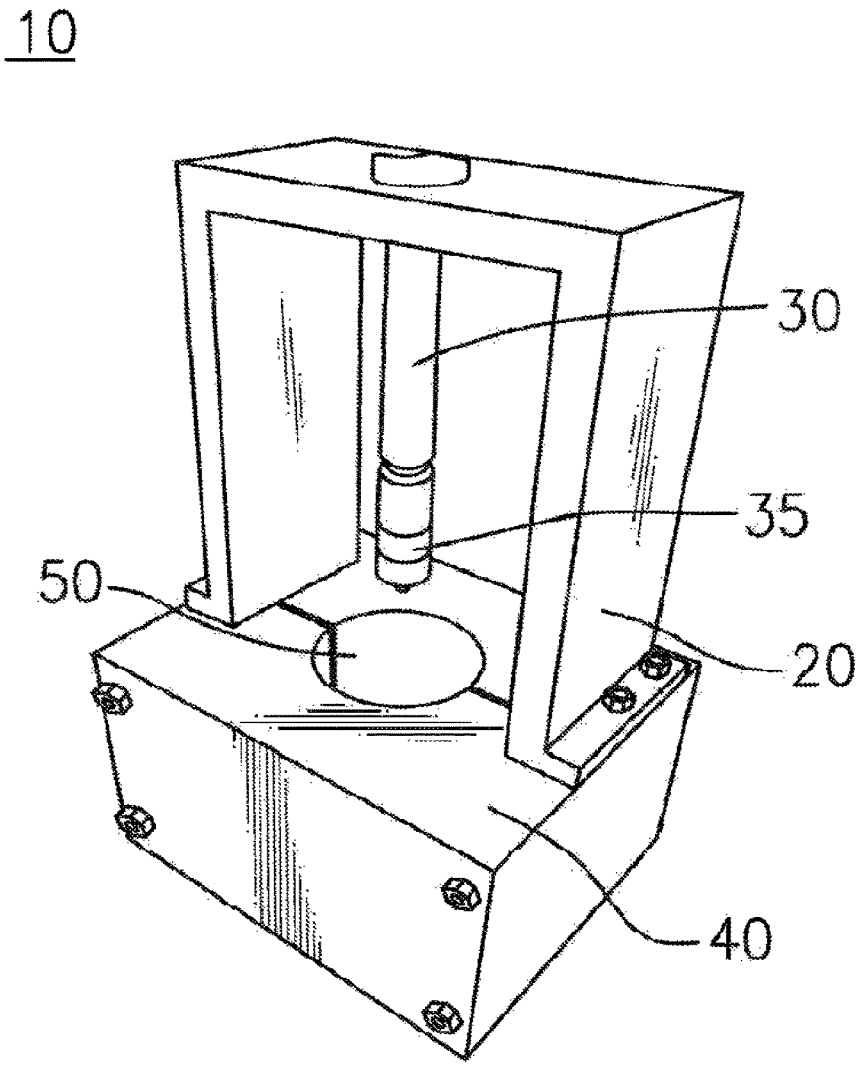
FIGS. 2A-2C are illustrations of one embodiment of a crucible curing device for use in making a crucible in accordance with the description herein.
Figure 2B:
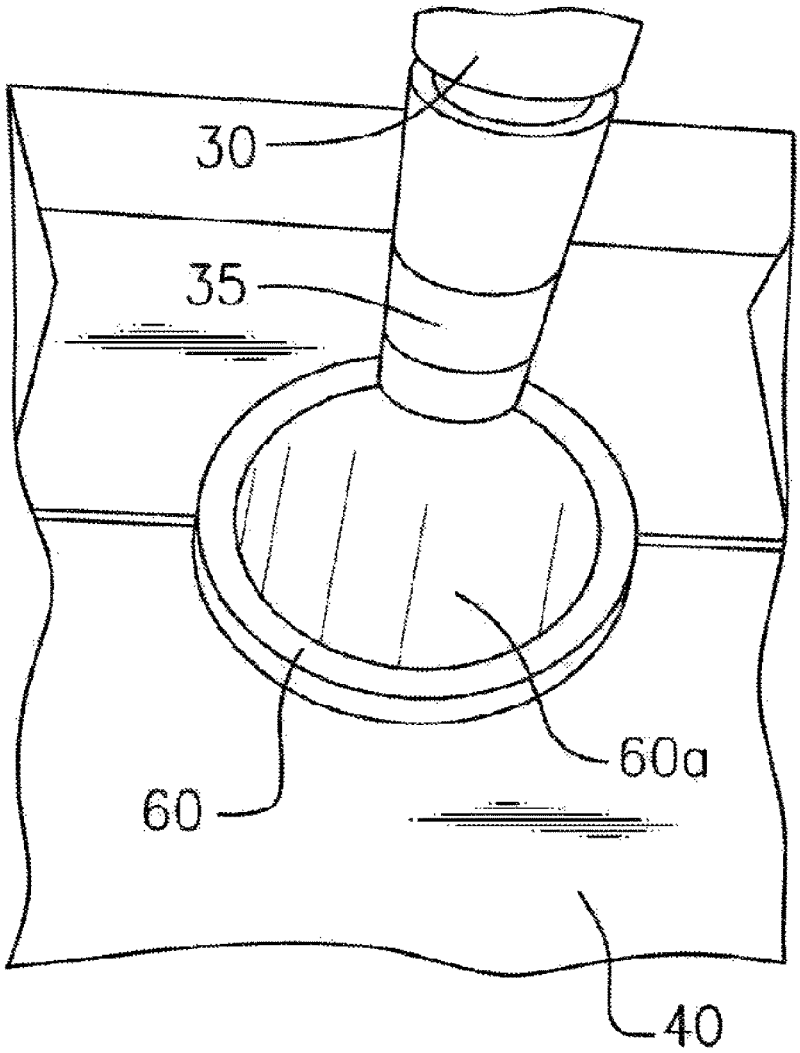
Figure 2C:
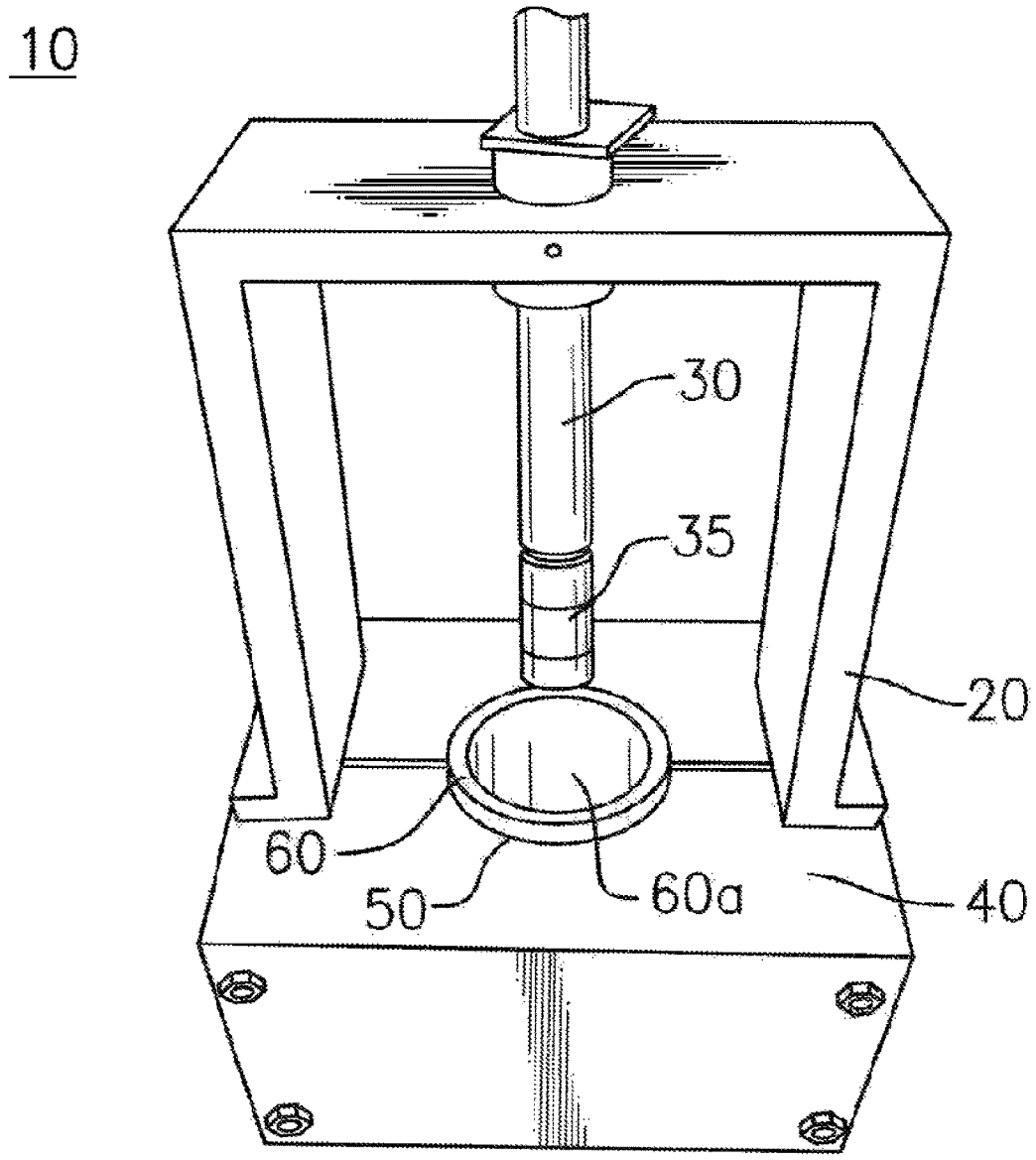

In one embodiment, a suitable crucible curing device for use in this method can be the device illustrated in FIGS. 2A, 2B, and 2C. As shown, crucible curing device 10 is provided to include chamber 50 that works to complement crucible mold 60 (see FIGS. 2B and 2C) for the crucible. More particularly, FIGS. 2A-2C show crucible curing device 10 having base 40 that includes chamber 50 for holding crucible mold 60 therein; effector arm 30 for inserting and removing removable crucible cavity pattern 70 into and out of chamber 50, said effector arm 30 comprising adaptor portion 35 for removably coupling removable crucible cavity pattern 70 to a terminal end of effector arm 30; and support 20 for supporting and positioning effector arm 30 at a desired location above chamber 50, wherein said crucible curing device 10 is effective to produce a crucible that meets thermal shock resistance for melting titanium or titanium alloys for use in forming a titanium-containing article. As shown in FIG. 2B, crucible mold 60 includes crucible mold cavity 60 into which the crucible bulk layer composition can be poured for curing of the crucible.

The position of the effector arm controls the position of the removable pattern and the extrinsic facecoat in the crucible mold cavity. The position of the pattern in the crucible mold cavity controls the crucible bulk layer thickness and the wall thickness and the uniformity of thickness of the crucible walls. In one embodiment, the effector arm assists in positioning the pattern so that the crucible wall thickness does not vary by more than 30 percent, given that the bulk layer and the wall thickness affects the thermal performance of the crucible. Specifically, the wall thickness and the properties of the crucible wall, such as the elastic modulus, strength, thermal conductivity, and thermal expansion coefficient, control the thermal shock resistance of the crucible.

As noted, in one embodiment, the removable crucible cavity pattern can be introduced into the chamber of the crucible curing device prior to adding the bulk slurry into the crucible mold that is housed in the chamber, with the extrinsic facecoat being layered on the removable crucible cavity pattern prior to adding the bulk slurry. In this embodiment, the effector arm containing the removable crucible cavity pattern is lowered to a position to still allow the crucible slurry to be poured into the crucible mold. In one embodiment, the calcium aluminate containing slurry is fed into the annular gap between the mold and the removable crucible cavity pattern. Alternatively, in another embodiment, the removable crucible cavity pattern can include an inlet port for pouring the crucible slurry therethrough, which allows for the removable crucible cavity pattern to be substantially or completely inserted into the crucible mold prior to pouring the crucible slurry into the mold. In order to allow any gas contained in the crucible mold to escape during the pouring of the crucible slurry, the removable crucible cavity pattern, or the mold, can also include an exhaust port for allowing such gas to escape from the crucible mold as the crucible slurry is being poured.

The crucible slurry investment mix for use with the crucible curing device is as described herein. In one embodiment, the slurry is produced by the process as follows: combining calcium aluminate with a liquid to produce a slurry of calcium aluminate, wherein the percentage of solids in the initial calcium aluminate/liquid mixture is about 60% to about 80% and the viscosity of the slurry is about 50 to about 150 centipoise; and adding oxide particles into the slurry such that the solids in the final calcium aluminate/liquid mixture with the large-scale oxide particles is about 65% to about 90%.

Effector arms can be made of any material that can function as an adaptor for a removable crucible cavity pattern as described herein. Suitable materials for the effector arm can include, without limitation, metal, ceramic, metallic or polymeric composites, and the like. Removable crucible cavity patterns can be made of any material that can function as a fugitive pattern or as a pattern that can withstand melting when it comes into contact with the crucible slurry during curing of the crucible in the crucible mold. The removable crucible cavity pattern can be inserted into the chamber of the crucible curing device at a position suitable to produce a crucible of the sizes and shapes as described herein. The crucible mold, removable crucible cavity pattern, and crucible curing pattern comprise a tooling system effective to work together to yield concentricity of the inner and outer surfaces of the crucible to ensure control of the wall thickness.

In particular, once the removable crucible cavity pattern with the extrinsic facecoat is in place at the desired position in or just above the chamber housing the crucible mold, the crucible composition mixture can be poured into the crucible mold and then allowed to cure under sufficient conditions, as described herein, to allow the crucible bulk layer composition to cure. After curing, the removable crucible cavity pattern can be removed, leaving a crucible that can be taken from the crucible mold and used for melting titanium and titanium alloys, as provide herein. In another particular embodiment, the crucible bulk layer composition can be poured into the crucible mold before the removable crucible cavity pattern with the extrinsic facecoat is inserted into the crucible mold cavity. In such an embodiment, after the crucible composition is poured into the crucible mold, the effector arm can be manipulated so as to lower the removable crucible cavity pattern downward and into the crucible mold in a controlled manner to a desired position. As the removable crucible cavity pattern with the extrinsic facecoat comes into contact with and is submerged into the crucible composition (e.g., crucible slurry), the crucible mix is extruded back into the gap between the removable crucible cavity pattern with the extrinsic facecoat and the crucible mold cavity, excess crucible composition is moved by this physical force out of the crucible mold until the removable crucible cavity pattern is at the desired depth and location within the crucible mold. The removable crucible cavity pattern is then kept in that position until the curing process has been completed.

Without intending to limit the scope of the present invention, by way of operation, in one embodiment, the crucible curing device provides a tooling assembly that establishes the relative positions of the metal mold, the removable polyurethane crucible mold liner, and the removable crucible cavity pattern with the extrinsic facecoat. The tooling assembly controls the alignment of the axis of symmetry of the mold and the removable crucible cavity pattern, and the relative z-axis positions of the base of the removable crucible cavity pattern and the polyurethane crucible mold liner. For an axisymmetric crucible geometry, the assembly tooling is effective to keep the crucible cavity centered in the body of the tooling in order to control the wall thickness of the sides and at the base of the resulting crucible. The removable crucible cavity pattern is positioned with regard to the x, y, and z coordinates, and, for an axisymmetric geometry, the axis of symmetry of the removal pattern is correctly aligned within acceptable tolerances with the axis of symmetry of the crucible mold cavity/removable polyurethane crucible mold liner in order to make an axisymmetric crucible with a wall thickness that is uniform within acceptable tolerances for the application.

The formed crucible may be a green crucible, and the method may further comprise firing the green crucible. In one embodiment, the melting crucible comprises an investment casting crucible, for example, for casting a titanium-containing article. In one embodiment, the titanium-containing article comprises a titanium aluminide article. In one embodiment, the investment casting-crucible composition comprises an investment casting-crucible composition for casting near-net-shape titanium aluminide articles. The near-net-shape titanium aluminide articles may comprise near-net-shape titanium aluminide turbine blades. In one embodiment, the system is directed to a crucible formed from a titanium-containing article casting-crucible composition, as taught herein. Another aspect is directed to an article formed using the aforementioned crucible.

In another aspect, the present disclosure provides a method for melting titanium and titanium alloys. This method involves the following steps: (i) providing a crucible according to the present disclosure; (ii) preheating the crucible; and (iii) melting titanium or a titanium alloy in the heated crucible to produce molten titanium or molten titanium alloy.

In another aspect, the present disclosure provides a casting method for titanium and titanium alloys. This method involves the following steps: (i) performing the method of melting titanium and titanium alloys of the present disclosure in order to yield molten titanium or molten titanium alloy; (ii) pouring the molten titanium or the molten titanium alloy into an investment mold; (iii) solidifying the molten titanium or the molten titanium alloy to form a solidified titanium or titanium alloy casting; and (iv) removing the solidified titanium or titanium alloy casting from the mold. The solidified titanium or titanium alloy casting can then be removed from the mold. In one embodiment, this method can involve firing the mold prior to delivering the molten titanium or titanium alloy from the crucible into the casting mold. In one embodiment, a titanium or titanium alloy article is provided that is made by the melting and casting methods as taught herein.

In one embodiment, the present disclosure provides a titanium or titanium alloy casting made by a casting method comprising: obtaining an investment casting crucible composition comprising calcium aluminate and aluminum oxide; pouring the investment casting crucible composition into a vessel containing a fugitive pattern having a rare earth oxide containing extrinsic facecoat layered thereon; curing the investment casting crucible composition; removing the fugitive pattern from the crucible; firing the crucible; preheating the mold to a mold casting temperature; melting the titanium or titanium alloy in the crucible, pouring the molten alloy from the crucible into the mold; solidifying the molten titanium or titanium alloy to form the casting; and removing a solidified titanium or titanium alloy casting from the mold. In one embodiment, the present system is directed to a titanium or titanium alloy article made by the melting and casting methods taught in this application.

As the molten metals are heated higher and higher, they tend to become more and more reactive (e.g., undergoing unwanted reactions with the crucible surface). Such reactions lead to the formation of impurities that contaminate the metal parts, which result in various detrimental consequences. The presence of impurities shifts the composition of the metal such that it may not meet the desired standard, thereby disallowing the use of the cast piece for the intended application. Moreover, the presence of the impurities can detrimentally affect the mechanical properties of the metallic material (e.g., lowering the strength of the material).

One aspect is directed to a crucible composition for melting and casting a titanium-containing article, comprising calcium aluminate. The crucible composition further comprises hollow alumina particles. The crucible composition further comprises hollow alumina particles. The article may comprise a metallic article. In one embodiment, the article comprises a titanium aluminide-containing article. In another embodiment, the article comprises a titanium aluminide turbine blade. In yet another embodiment, the article comprises a near-net-shape, titanium aluminide turbine blade. This near-net-shape, titanium aluminide turbine blade may require little or no material removal prior to installation in the operating application, such as a gas turbine or aircraft engine.

As discussed herein, one method of making the extrinsic facecoat of the crucible of the present disclosure involves the use of slurry and stucco layering techniques. For example, facecoat layer 18 may comprise a facecoat slurry made from a powder of the rare earth oxide mixed into a colloidal suspension. In one embodiment, the oxide powder may be a small particle powder having a size of less than about 70 microns, and in another embodiment, from about 0.001 microns to about 50 microns, and in yet another embodiment from about 1 micron to about 50 microns. The colloid can be any colloid that gels in a controlled fashion, such as, for example, colloidal silica, colloidal yttria, colloidal alumina, colloidal calcium oxide, colloidal magnesium oxide, colloidal zirconium dioxide, colloidal lanthanide series oxides, and mixtures thereof. While any of the previously listed oxides can be used to make the facecoat slurry of facecoat layer 18, in one embodiment, the facecoat slurry may comprise yttrium oxide particles in a colloidal silica suspension, while in another embodiment, the facecoat slurry may comprise yttrium oxide particles in a colloidal yttria suspension. The composition of the facecoat slurry can vary, however, in general, the facecoat slurry may comprise from about 40% to about 100% of the oxide and from about 0% to about 60% of the colloid, by weight.

Once the facecoat slurry of facecoat layer 18 is prepared using conventional practices, the removable pattern may be exposed to the facecoat slurry using a method selected from the group consisting of dipping, spraying, and combinations thereof. Generally, once applied, the slurry layer that forms the facecoat layer 18 can have a thickness of from about 10 microns to about 500 microns, and in one embodiment from about 50 microns to about 400 microns, in another embodiment from about 150 microns to about 300 microns, and in yet another embodiment about 200 microns.

Figure 3:
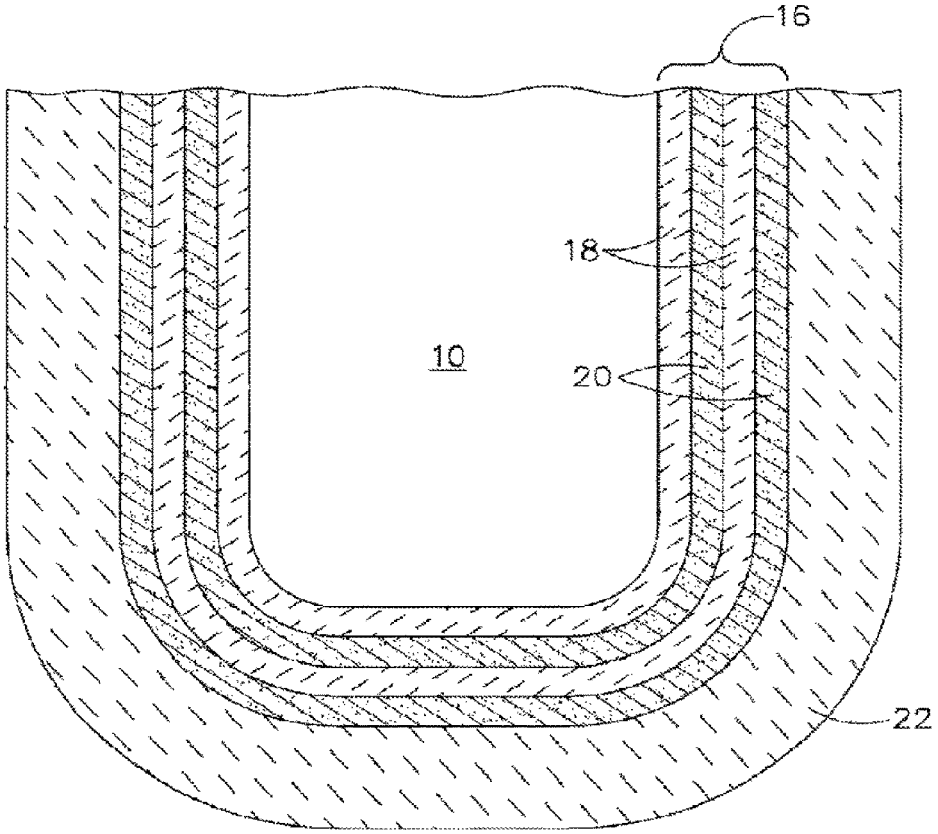
FIG. 3 is a schematic cross-sectional view of one embodiment of a crucible mold in accordance with the description herein.
Figure 4:
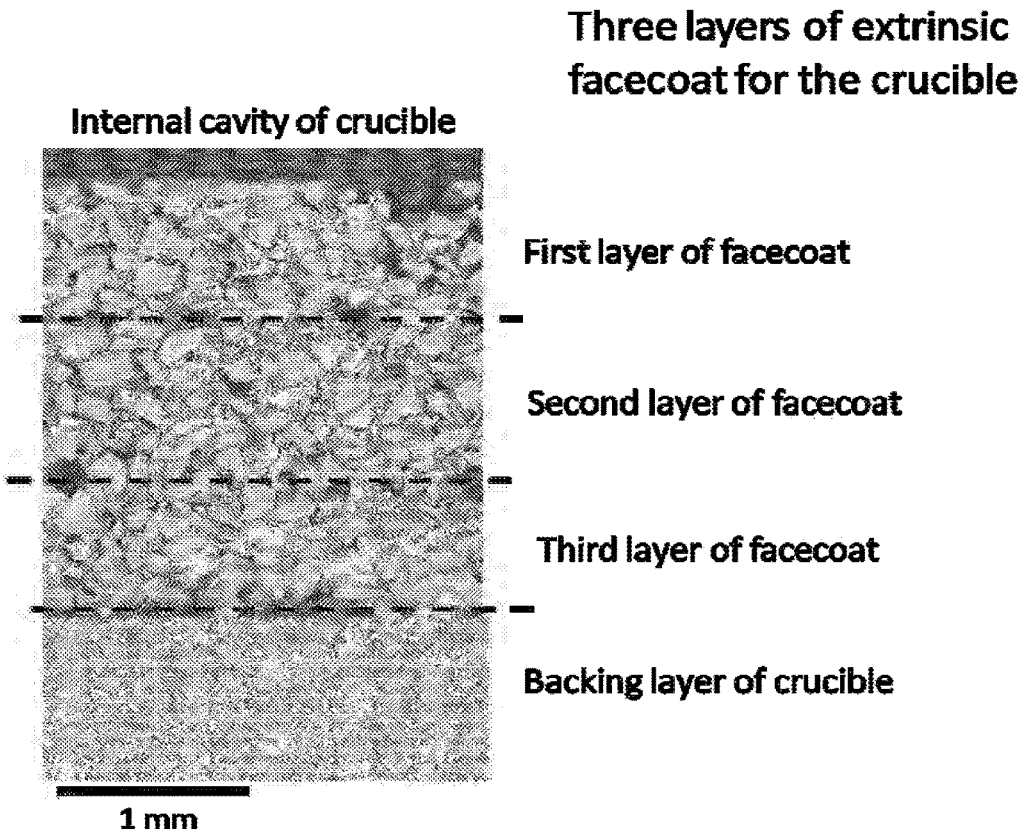
FIG. 4 is a micrograph in the scale provided of the extrinsic facecoat and part of the backing layer of one embodiment of a crucible cross-section after the second firing in accordance with the description herein. The embodiment shows an extrinsic facecoat having three extrinsic facecoat layers.

While still wet, the slurry layer that forms the facecoat layer 18 may optionally be coated with a stucco layer 20, as shown in FIG. 3. As used herein, "stucco" refers to coarse ceramic particles generally having a size greater than about 100 microns, and in one embodiment from about 100 microns to about 5000 microns. Stucco 20 can be applied to each facecoat layer to help build up the thickness of the crucible wall and provide additional strength. A variety of materials may be suitable for use as stucco layer 20, however, in one embodiment, the stucco may comprise a refractory material, such as, but not limited to, alumina or aluminosilicates, combined with an oxide, as defined herein. The stucco may comprise a rare earth oxide based material, such as, but not limited to yttrium oxide. The ratio of the refractory material to the oxide in stucco layer 20 can vary, however, in one embodiment, stucco layer 20 can comprise from about 0% to about 60% of the refractory material and from about 40% to about 100% of the oxide, by weight. Stucco layer 20 may be applied to facecoat layer 18 in any acceptable manner, such as dusting for example. Generally, stucco layer 20 can have a thickness of from about 100 microns to about 2000 microns, and in one embodiment from about 150 microns to about 300 microns, and in yet another embodiment about 200 microns.

Facecoat layer 18, and optional stucco layer 20 can be air-dried and additional facecoat layers and stucco layers may be applied in the manner described previously, if desired, to complete facecoat 16. In the embodiments shown in FIG. 3, first and second facecoat layers 18, and alternating stucco layers 20, are present, though those skilled in the art will understand that facecoat 16 may comprise any number of facecoat layers and stucco layers. While each facecoat layer 18 may comprise a different oxide/colloid mixture, in one embodiment, each facecoat layer 18 comprises the same oxide/colloid mixture. Once the desired number of facecoat layers 18 and stucco layers 20 have been applied, facecoat 16 is complete and the bulk layer containing calcium aluminate is applied.

It should be noted that in some cases it may be desirable to grade the stucco layers by altering particle size, layer thickness and/or composition as they are applied. As used herein, the term "grade," and all forms thereof, refers to gradually increasing the strength of subsequently applied stucco layers by, for example, increasing the particle size of the stucco material, increasing the thickness of the stucco layer and/or utilizing increasingly stronger refractory material/colloid compositions as the stucco layer. Such grading can allow the stucco layers to be tailored to account for differences in thermal expansion and chemical properties of the various facecoat layers and backing layers to which they are applied. More specifically, grading the stucco layers provides differing porosities and can adjust the modulus of the crucible, which taken together, can help account for the differences in thermal expansion as previously discussed.

The hollow crucible mold 26 can then be fired to higher temperatures. Firing crucible mold 26 can help provide additional strength to the finished crucible because during this heating process, the materials that make up the extrinsic facecoat layers, and stucco, layers can interdiffuse with one another and sinter together. Initially, the crucible can be fired to a temperature of from about 800° C. to about 1400° C., and in one embodiment from about 900° C. to about 1100° C., and in one embodiment about 1000° C. This first firing can take place for any length of time needed to help burn off any remaining form material, as well as provide a limited degree of interdiffusion among the ceramic constituents of the crucible, which in one embodiment may be from about 0.5 hours to about 50 hours, in another embodiment from about 1 hour to about 30 hours, and in yet another embodiment about 2 hours. Next, the crucible can be fired to a temperature of from about 1400° C. to about 1750° C., and in one embodiment from about 1500° C. to about 1750° C., and in yet another embodiment from about 1600° C. to about 1700° C. This second firing can take place for any length of time needed to substantially complete the interdiffusion of the ceramic constituents, as well as cause a reaction of the colloid present in the facecoat oxide, which in one embodiment may be from about 0.5 hours to about 50 hours, in another embodiment from about 1 hour to about 30 hours, and in yet another embodiment about 2 hours. For example, colloidal silica can form silicates, while colloidal yttria can sinter with yttria particles present in the slurry of the extrinsic facecoat.

Regardless of the specific construction, crucible 8 may be used to melt titanium alloys having a low interstitial level and a low ceramic inclusion content. In particular, TiAl can be melted in the crucible described herein using conventional melting and casting techniques known to those skilled in the art. The crucibles described herein are capable of use with such highly reactive alloys because the materials used to make the facecoat are inert to the reactive TiAl. In other words, the facecoat can be exposed to the TiAl during melting without degrading and contaminating the alloy. Moreover, the crucibles herein can be heated rapidly without cracking during any of the melting, pouring, casting and cooling stages of the vacuum induction melting cycle.

Examples

The present invention, having been generally described, may be more readily understood by reference to the following examples, which are included merely for purposes of illustration of certain aspects and embodiments of the present invention, and are not intended to limit the present invention in any way.

The Invested Crucible Extrinsic Facecoat, Bulk Composition, and Formulation

A range of crucibles have been prepared, the invested mixture consists for the bulk layer of the crucible consists of calcium aluminate cement with 80% alumina and 20% calcia, alumina particles, water, and colloidal silica.

In a first example, a typical slurry mixture for making an invested mix for making a crucible with an extrinsic facecoat and a calcium aluminate cement-containing bulk layer consisted of 1100 g of 80% calcium aluminate cement, 598 g of high-purity bubble alumina particles of a size range from 0.5-1 mm diameter, 374 g of deionized water, and 37 g of colloidal silica, Remet LP30. This formulation was used to produce two crucibles that were approximately 60 mm internal diameter and 150 mm long, with a wall thickness of 8 mm. The crucibles that were so produced were used successfully for casting titanium aluminide components with an oxygen content of less than 2000 ppm. The crucibles also had a density of less than the theoretical density of the parent oxides. The alumina bubble in the bulk layer of the crucible improved the thermal shock resistance of the bulk layer of the crucible. The low density provided improved thermal compliance and resistance to thermal shock on melting.

The ceramic mix for making the bulk layer of the crucible was prepared by mixing the cement, water, and colloidal silica in a container. In a preferred embodiment, a high-shear form of mixing was used. If not mixed appropriately the cement can gel, and it will make a mix that cannot be used. When the cement was in full suspension in the mixture, the larger-size alumina particles (for example 0.5-1.0 mm) were added and mixed with the cement-alumina formulation. The viscosity of the final mix is important; it should not be too low or too high, as will be described subsequently.

After mixing, the invested mix was poured in a controlled manner into a vessel that contained the fugitive pattern, which is typically wax with the extrinsic facecoat applied to it using a dip and stucco process. The extrinsic facecoat can consist of several layers. A single layer or multiple layers can be used. The vessel provides the external geometry of the crucible, and the fugitive pattern with the yttria- or rare earth-containing extrinsic facecoat generates the internal geometry. The correct pour speed is one parameter of interest. If it is too fast, air can be entrapped in the crucible; if it is too slow, separation of the cement and the alumina particulate can occur.

The ratio of the wall thickness to the crucible diameter was approximately 1:8. The ratio of the extrinsic facecoat thickness to the wall thickness was 1:6. The extrinsic facecoat thickness was typically approximately 1500 microns. The range of ratios of the extrinsic facecoat thickness to the wall thickness that have been examined is 1:4 to 1:27.

In a second example, an invested bulk layer of the crucible was formed by formulating the invested mix of the ceramic components, and pouring the mix into a vessel that contains a fugitive pattern that contains the extrinsic facecoat; the extrinsic facecoat was produced by a slurry-dip-stucco process. The invested bulk layer of the crucible formed on the extrinsic facecoat that was dipped on the removable/wax pattern was allowed to cure thoroughly to form a so-called green crucible. Typically, curing is performed for times from 1 hour to 48 hours. The fugitive pattern was then selectively removed from the green crucible by melting, dissolution, ignition, or other known pattern removal technique. Typical methods for wax pattern removal include oven dewax (less than 150° C.), furnace dewax (greater than 150° C.), steam autoclave dewax, and microwave dewaxing.

For melting titanium alloys, and titanium aluminide and its alloys, the green crucible then is fired at a temperature above 600 degrees C., preferably 700 to 1650 degrees C., for a time period in excess of 1 hour, preferably 2 to 6 hours, to develop crucible strength for melting and to remove any undesirable residual impurities in the crucible, such as metallic species (Fe, Ni, Cr), and carbon-containing species. The atmosphere of firing the crucible is typically ambient air, although inert gas or a reducing gas atmosphere can be used. The firing process removes the water from the crucible and converts residual phases in the bulk layer of the crucible to calcium monoaluminate and calcium dialuminate. The firing process also acts to convert any silica in the extrinsic facecoat to yttrium silicate, such as yttrium monosilicate and yttrium disilicate. Another purpose of the crucible firing procedure is to minimize any free silica that remains in the extrinsic facecoat and the bulk layer of the crucible prior to melting. Other purposes are to increase the high temperature strength, and increase the amount of calcium monoaluminate and calcium dialuminate in the bulk layer of the crucible.

The treatment of the crucible from room temperature to the final firing temperature can also be important with regard to the bulk layer of the crucible and the extrinsic facecoat. The heating rate to the firing temperature, and the cooling rate after firing are very important. If the green crucible is heated too quickly it can crack internally or externally, or both; crucible cracking prior to melting is highly undesirable. In addition, if the crucible is heated too quickly the internal surface/extrinsic facecoat of the crucible can crack and spall off; this can lead to undesirable inclusions in the alloy during melting and in the final casting in the worst case, and poor surface finish, even if there are no inclusions. If the crucible is cooled too quickly after reaching the maximum temperature, the crucible can also crack internally or externally, or both.

The new crucible construction described in the present disclosure letter is particularly suitable for titanium and titanium aluminide alloys. The crucible composition and construction of the layers after firing and before melting is very important, particularly with regard to the constituent phases. For melting purposes, a high weight fraction of calcium monoaluminate in the bulk layer of the crucible is preferred. In addition, for melting purposes it is desirable to minimize the weight fraction of the mayenite, because mayenite is water sensitive and it can provide problems with water release and gas generation during melting. After firing, the bulk layer of the crucible can also contain small weight fractions of aluminosilicates, calcium aluminosilicates, and transitional aluminas; it is important that the sum of the weight fraction of aluminosilicates and calcium aluminosilicates in the bulk layer of the crucible is kept to less than 5% in order to minimize reaction of the crucible with the casting.

The selection of the correct calcium aluminate cement chemistry and alumina formulation are critical to the performance of the crucible during melting. In terms of the calcium aluminate cement, it is necessary to have a minimum amount of free CaO in order to minimize reaction with the titanium alloy, as described previously.

In a third example, two smaller crucibles were produced using a slurry mixture that consisted of 600 g of the 80% calcium aluminate cement, 326 g of high-purity alumina bubble of a size range from 0.5-1 mm diameter, 204 g of deionized water, and 20 g of Remet LP30, colloidal silica. The alumina bubbles provide a crucible with a reduced density and more thermal compliance. The weight fraction of calcium aluminate cement is 65%, and that of the alumina bubble is 35%. The tooling used was similar to that shown in the attached figure. This formulation was used to produce the bulk layer of two crucibles that were approximately 50 mm internal diameter and 90 mm long. The crucibles were then cured and fired at high temperature. The crucibles that was so produced were used successfully for melting titanium aluminide slab castings with a good surface finish for mechanical property measurement.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention.

Additionally, while various embodiments of the invention have been described, it is to be understood that aspects of the present invention may include only some of the described embodiments. Accordingly, the invention is not to be seen as limited by the foregoing description, but is only limited by the scope of the appended claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A method for forming a crucible for melting titanium and titanium alloys useful in making a titanium-containing article, said method comprising:

combining calcium aluminate cement with a liquid to produce a first slurry, wherein the percentage of solids in the first slurry is within the range of about 60% to about 80% and the viscosity of the first slurry is within the range of about 50 centipoise to about 150 centipoise;

adding large-scale oxide particles greater than 50 microns in size into the first slurry to form a second slurry, wherein the percentage of solids in the second slurry is within the range of about 65% to about 900/%;

introducing the second slurry into a crucible mold cavity with a removable crucible cavity pattern inserted into the crucible mold cavity; and allowing the second slurry to cure in the crucible mold cavity and around the removable crucible cavity pattern to form a crucible for use in melting titanium and titanium alloys with a wall that defines a thickness that does not vary by more than 30 percent throughout the crucible.

2. The method as recited in claim 1, further comprising combining fine-scale alumina particles less than 10 microns in size with the calcium aluminate cement and the liquid to produce the first slurry.

3. The method as recited in claim 2, wherein the fine-scale alumina particles include hollow alumina particles.

4. The method as recited in claim 1, wherein the large-scale oxide particles are large-scale alumina particles.

5. The method as recited in claim 1, wherein the calcium aluminate cement comprises calcium monoaluminate, calcium dialuminate, and mayenite.

6. The method as recited in claim 1, wherein the calcium aluminate cement comprises more than about 30% by weight of the second slurry.

7. The method as recited in claim 1, further comprising firing the formed crucible at a temperature of between about 600° C. and about 1650° C., and wherein the fired crucible includes a weight fraction of 0.15 to 0.8 of calcium monoaluminate and a weight fraction of 0.01 to 0.2 of mayenite.

8. The method as recited in claim 1, wherein the percentage of solids in the second slurry is within the range of about 75% to about 900/%.

9. The method as recited in claim 1, wherein the second slurry forms at least one extrinsic facecoat layer comprising a rare earth oxide, and wherein the cavity of the formed crucible is defined by an exposed surface of the at least one extrinsic facecoat layer.

10. The method as recited in claim 9, wherein the second slurry further forms a bulk behind the at least one extrinsic facecoat layer, and wherein the bulk and the at least one extrinsic facecoat layer form the wall that defines a thickness that does not vary by more than 30 percent throughout the crucible.

11. The method as recited in claim 10, further comprising incorporating a bonding layer between the at least one extrinsic facecoat layer and the bulk, said bonding layer comprising a fine-scale calcium aluminate cement having a particle size of less than 50 microns.

12. The method as recited in claim 11, wherein the bulk, the at least one extrinsic facecoat layer and the bonding layer form the wall that defines a thickness that does not vary by more than 30 percent throughout the crucible.

13. The method of claim 1, further comprising:

firing the formed crucible at a temperature between about 600° C. and about 1650° C., wherein the fired crucible includes a weight fraction of 0.15 to 0.8 of calcium monoaluminate and a weight fraction of 0.01 to 0.2 of mayenite.

14. A method for forming a crucible for melting titanium and titanium alloys, the method comprising:

introducing a slurry into a crucible mold cavity with a removable crucible cavity pattern inserted into the crucible mold cavity, wherein the slurry is formed by a combination of a) calcium aluminate cement with a liquid, wherein the percentage of solids in the combination is within the range of about 60% to about 80% and the viscosity of the combination is about 50 centipoise to about 150 centipoise, and b) large-scale oxide particles greater than 50 microns in size added to the combination to form the slurry; and allowing the slurry to cure in the crucible mold cavity and around the removable crucible cavity pattern to form a crucible for use in melting titanium and titanium alloys with a wall that defines a thickness that does not vary by more than 30 percent throughout the crucible.

15. The method of claim 14, wherein the combination further comprises fine-scale hollow alumina particles less than 10 microns in size.

16. The method of claim 14, wherein the large-scale oxide particles are large-scale alumina particles.

17. The method of claim 14, wherein the calcium aluminate cement comprises calcium monoaluminate, calcium dialuminate, and mayenite.

18. The method of claim 14, wherein the calcium aluminate cement comprises more than about 30% by weight of the slurry.

19. The method of claim 14, wherein the slurry forms at least one extrinsic facecoat layer comprising a rare earth oxide, the cavity of the formed crucible is defined by an exposed surface of the at least one extrinsic facecoat layer, the slurry further forms a bulk behind the at least one extrinsic facecoat layer, and the bulk and the at least one extrinsic facecoat layer form the wall that defines a thickness that does not vary by more than 30 percent throughout the crucible.

20. The method of claim 19, further comprising:

incorporating a bonding layer between the at least one extrinsic facecoat layer and the bulk, the bonding layer comprising a fine-scale calcium aluminate cement having a particle size of less than 50 microns.

* * * * *